US008175318B2

(12) United States Patent
Pieklik et al.

(10) Patent No.: US 8,175,318 B2
(45) Date of Patent: May 8, 2012

(54) SPEAKER

(75) Inventors: William R. Pieklik, Baltimore, MD (US); Timothy P. Conroy, Annapolis, MD (US)

(73) Assignee: The Poly-Planar Group, LLC, New York, NY (US)

( * ) Notice: Subject to any disclaimer, the term of this patent is extended or adjusted under 35 U.S.C. 154(b) by 1257 days.

(21) Appl. No.: 11/846,970

(22) Filed: Aug. 29, 2007

(65) Prior Publication Data

US 2008/0095395 A1 Apr. 24, 2008

Related U.S. Application Data

(60) Provisional application No. 60/840,947, filed on Aug. 30, 2006.

(51) Int. Cl.
*H04R 1/02* (2006.01)

(52) U.S. Cl. ..... 381/387; 4/541.1

(58) Field of Classification Search ..... 381/387, 381/189, 334, 388, 395; 4/541.1, 559
See application file for complete search history.

(56) References Cited

U.S. PATENT DOCUMENTS

| | | | | |
|---|---|---|---|---|
| 3,585,991 | A | 6/1971 | Balamuth | |
| 4,575,882 | A | 3/1986 | Diamond | |
| 5,321,760 | A | 6/1994 | Gray | |
| 6,343,135 | B1 | 1/2002 | Ellero et al. | |
| 6,467,103 | B1 | 10/2002 | Gardenier et al. | |
| 6,608,909 | B2 | 8/2003 | Brady | |
| 6,754,916 | B1 | 6/2004 | Cox | |
| 6,868,563 | B1 | 3/2005 | Hutchings et al. | |
| 7,218,746 | B2 | 5/2007 | Schmidt et al. | |
| 7,814,583 | B2 * | 10/2010 | Lerma | 4/541.1 |
| 2004/0016051 | A1 | 1/2004 | Gardenier et al. | |
| 2004/0047484 | A1 | 3/2004 | Gardenier et al. | |
| 2004/0068787 | A1 | 4/2004 | Lauter et al. | |
| 2004/0156517 | A1 | 8/2004 | Schmidt et al. | |
| 2005/0091739 | A1 | 5/2005 | Lerma | |

OTHER PUBLICATIONS

Poly-planar Waterproof Marine Audio Systems: Pop-Up Speaker, Part No. MA-7020G, The Waterproof Marine Audio System with the Concert Hall Sound, © 1997-2007, Poly-Planar LLC, 2007.

* cited by examiner

*Primary Examiner* — Mark Prenty
(74) *Attorney, Agent, or Firm* — Knobbe Martens Olson & Bear, LLP

(57) ABSTRACT

A speaker apparatus comprising a housing and a speaker member. The speaker member is configured to rotate relative to the housing and translate relative to the housing so as to move between a retracted position within the housing and an extended position relative to the housing. In some embodiments, the speaker member axially translates independent of the rotational orientation of the speaker member relative to the housing. In some embodiments, the speaker member rotates through substantially 360 degrees relative to the housing.

26 Claims, 28 Drawing Sheets

SPEAKER

RELATED APPLICATIONS

This application claims priority under 35 U.S.C. §119(e) to U.S. Provisional Application No. 60/840,947, entitled "ROTATING EXTENDABLE LOUDSPEAKER SYSTEM FOR SPA APPLICATIONS," filed Aug. 30, 2006. The entire disclosure of the prior application is considered part of the disclosure of this application and is hereby incorporated by reference in its entirety.

BACKGROUND OF THE INVENTION

1. Field of the Invention

The invention is directed generally to a speaker, and more particularly to a rotatable pop-up speaker.

2. Description of the Related Art

Music is becoming more and more a part of every day life. Many people enjoy listening to music and want to do so in their hot tubs, spas, pools, and other similar recreational and therapeutic devices. For this purpose, speakers and the like are often installed near water sources or in locations exposed to moisture and other elements. However, to avoid any interaction between the water and the speaker components and wires, speakers are often installed far from the water source, often degrading the sound quality experience of the listener.

The rotational orientation of many such indoor and outdoor speakers is not easily adjustable, such that the sound is projected primarily in a fixed direction. Further, many such indoor and outdoor speakers are not retractable so as to be protected from exposure to chemicals, moisture, sunlight, etc., during periods of non-operation.

SUMMARY OF THE INVENTION

An aspect of the invention is directed to a speaker including a housing and a speaker member. The speaker member is configured to move between a retracted position and an extended position relative to the housing. The speaker member is positioned substantially inside the housing at least when the speaker member is in the retracted position. The speaker member is positioned substantially outside the housing at least when the speaker member is in the extended position. The speaker member is configured to rotate relative to the housing so as to define a rotational orientation relative to the housing. The speaker member moves between the retracted position and the extended position regardless of the rotational orientation.

Another aspect of the invention is a speaker apparatus that includes an outer housing and a middle housing rotatable relative to the outer housing so as to define a rotational orientation relative to said outer housing. The apparatus further comprises a speaker member engaged with the middle housing so that the speaker member and the middle housing rotate together relative to the outer housing. The speaker member moves between a retracted position and an extended position relative to the middle housing. The speaker member is positioned substantially inside the middle housing at least when the speaker member is in the retracted position. The speaker member is positioned substantially outside the middle housing at least when the speaker member is in the extended position. The apparatus further includes a biasing mechanism that moves at least in part the speaker member from the retracted position to the extended position independent of the rotational orientation of the speaker member.

Another aspect is a spa that has at least one speaker. The speaker includes a housing and a speaker member. The speaker member is configured to simultaneously rotate and axially translate relative to the housing so as to move between a retracted position and an extended position. The speaker member is positioned substantially inside the housing at least when the speaker member is in the retracted position. The speaker member is positioned substantially outside of the housing at least when the speaker member is in the extended position.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional speakers.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific features of the embodiments. In this description, reference is made to the drawings wherein like parts are designated with like numerals throughout the description and the drawings In the illustrated embodiments, the speaker apparatus 28 is generally comprised of a speaker member 30, a middle housing 32, and an outer housing 34. In the illustrated embodiment, the middle housing 32 comprises a first middle housing member 32*a* and a second middle housing member 32*b*. In the illustrated embodiment, the outer housing 34 comprises a first outer housing member 34*a* and a second outer housing member 34*b*.

Figure 1:
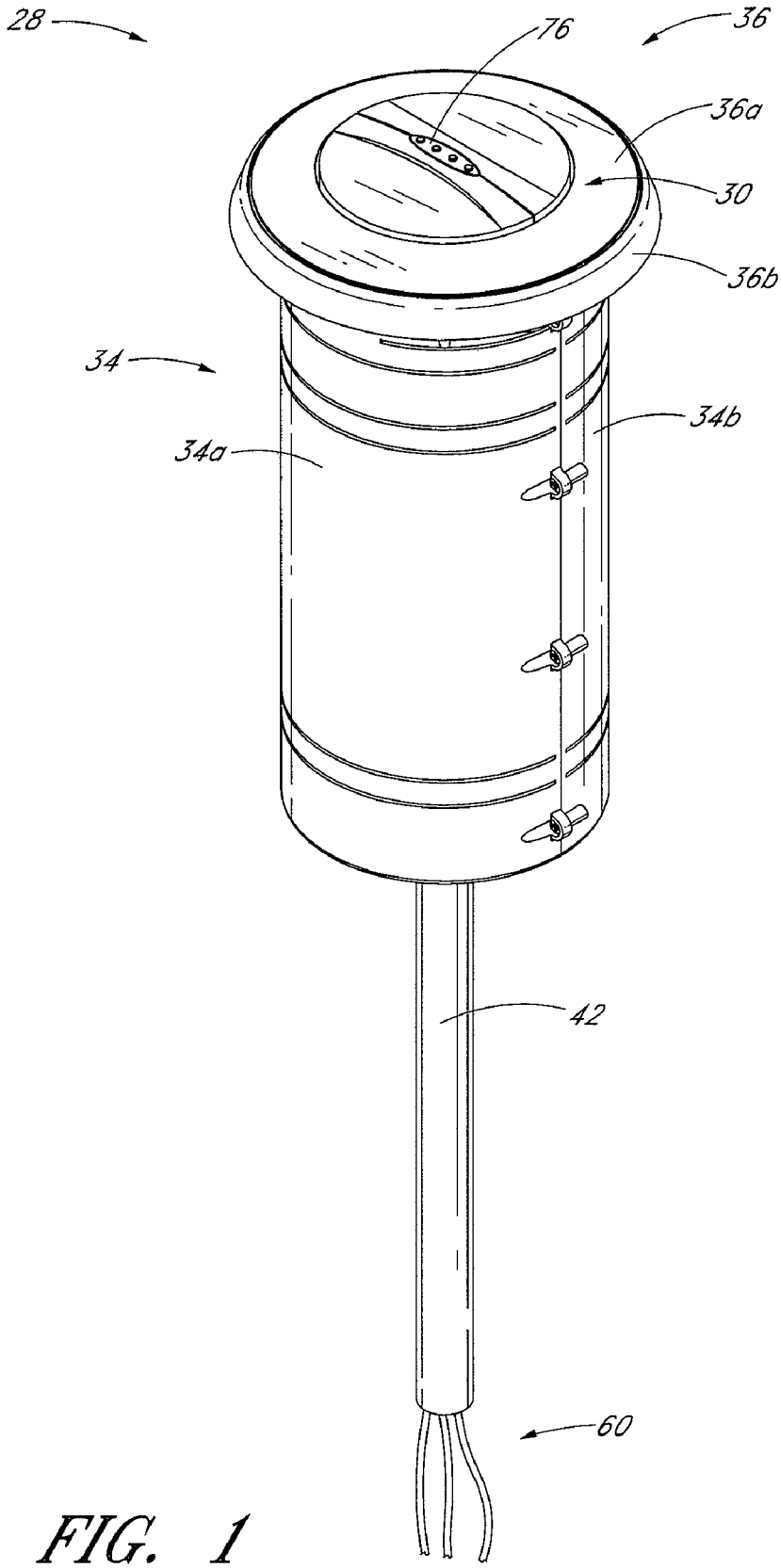
FIG. 1 is a perspective view of a speaker according to a preferred embodiment of the present invention in a retracted position.

FIG. 1 is a perspective view of a speaker 28 according to a preferred embodiment of the present invention in a retracted position. Retracted position means the speaker member 30 is positioned within the outer housing 34 such that a substantial portion of the speaker member 30 is disposed within the outer housing. An exemplary retracted position is illustrated in FIG. 1 where a top surface of the speaker member 30 is aligned with a top of a seal cover 36.

Figure 2:
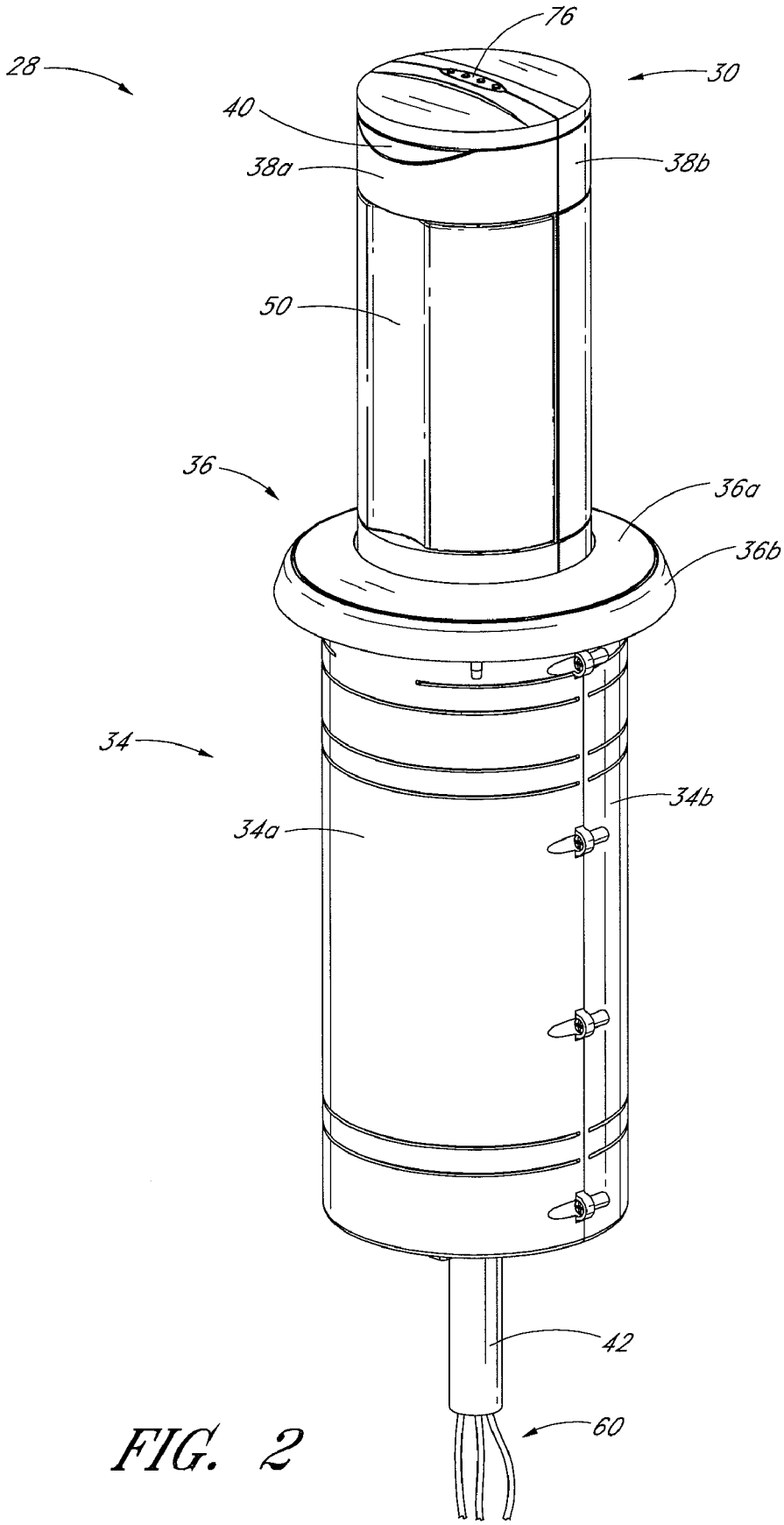
FIG. 2 is a perspective view of the speaker from FIG. 1 in the extended position.

FIG. 2 is a perspective view of the speaker 28 from FIG. 1 with the speaker member 30 in an extended position. The term extended position means the speaker member 30 is positioned outside the outer housing 34 such that a substantial portion of the speaker member 30 is exposed. An exemplary extended position is illustrated in FIG. 2 where at least a portion of the speaker member 30 is exposed above the seal cover 36. In this exemplary position, the speaker member 30 is positioned substantially completely above the outer housing 34 such that a bottom portion of the grill 50 is disposed above the top of the seal cover 36.

It is preferred that the speaker member 30 be positioned in the retracted, or stowed, position during periods of non-operation of the speaker apparatus 28 to protect the speaker member 30 from exposure to moisture, chemicals, sunlight, or other elements as well as to protect the speaker member 30 from impact damage with other objects.

Figure 1A:
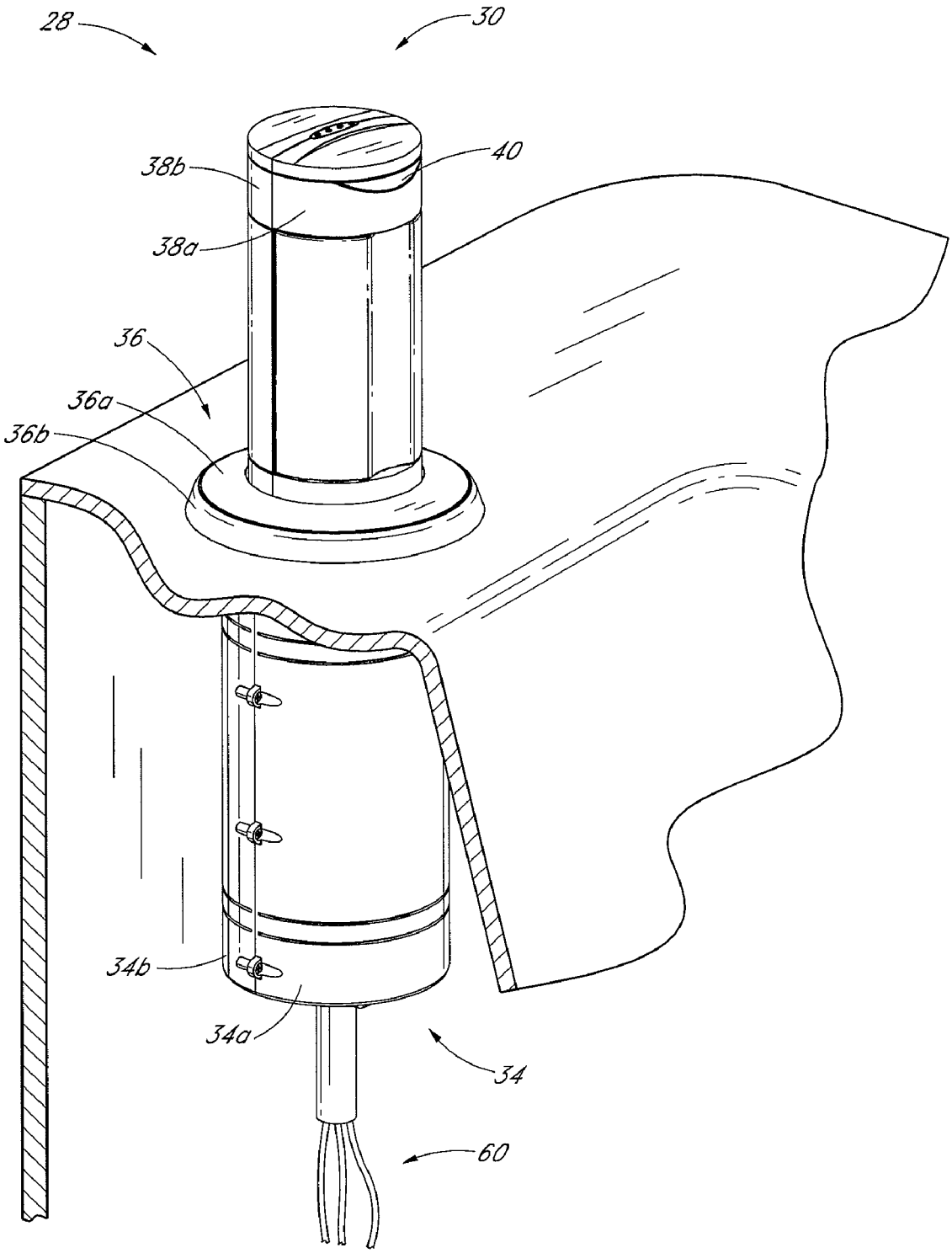
FIG. 1A is a perspective view of the speaker from FIG. 1 installed on a surface of a spa and in an extended position.
Figure 1B:
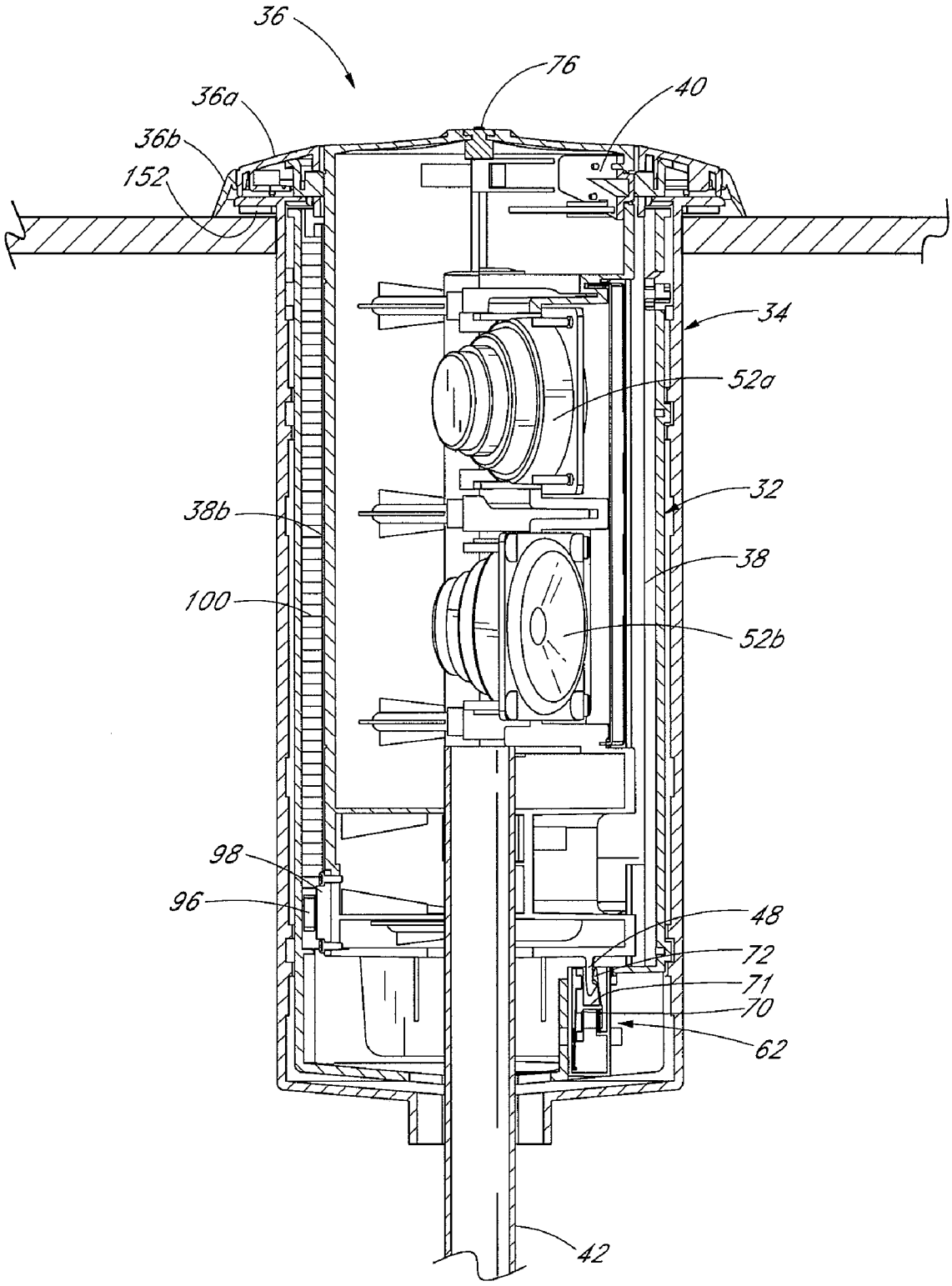
FIG. 1B is a section view of the speaker from FIG. 1A in the retracted position.

FIG. 1A is a perspective view of the speaker 28 from FIG. 1 installed on a surface of a spa and in an extended position. FIG. 1B is a section view of the speaker 28 from FIG. 1A in the retracted position. The speaker apparatus 28 may be configured to be substantially flush mounted through an opening in a top or side surface of a bathtub, pool, spa, or other water-containing object or water vehicle such that a cover can be placed over the top surface of the object without obstruction from the speaker apparatus 28 when the speaker member 30 is in the retracted position. In some embodiments, the speaker apparatus 28 is preferably mounted such that, in the extended position, the speaker member 30 is substantially above the water surface level of the spa. However, the speaker apparatus 28 is not so limited. The speaker apparatus 28 can be mounted on any surface where the user desires a pop-up, rotational speaker system such as, but not limited to, tables, counter-tops, work benches, desks, and other desired surfaces.

Although the term "spa" is used throughout this description, it is to be understood that the present invention is applicable to spas, hot tubs, pools, and other fluid bearing recreational or therapeutic devices. Accordingly, as used herein, the term "spa" is to be understood to mean all such fluid bearing recreational or therapeutic devices.

As will be described below in greater detail, the speaker member 30 is preferably deployed from the outer housing 34 to the extended position by simply depressing the top surface of the speaker member 30 so as to disengage a latch mechanism. The latch mechanism releasably holds the speaker member 30 in the retracted position. As stated, it is preferred that the speaker member 30 be positioned in the extended position during periods of operation of the speaker apparatus 28 so that the sound waves emanating from the speaker member 30 are not obstructed by the outer housing 34.

The speaker member 30 may be rotated relative to the outer housing 34. In some embodiments, a user may rotate the speaker member 30 to any desired angle. For example, the speaker member 30 may be rotated within or equal to an approximately 360 degree range. To affect rotation, a user may apply a rotational force to the outside of the speaker member 30. Alternatively, the speaker member 30 may be rotated by an electric motor. The electric motor may be controlled remotely by the user.

In some embodiments, the user rotates the speaker member 30 to any desired angle within or equal to an approximately 360 degree range by applying a rotational force to the outside of the speaker member 30. For example, the speaker member 30 may be rotated to any desired angle relative to the outer housing 34 through a range from 0 to approximately 358 degrees. In some embodiments, the speaker member 30 is inhibited from rotating beyond a 360 degree range by stops or other features located on middle housing 32 and the outer housing 34. An advantage of the stops is to limit the twisting of the wiring being routed to the speaker member 30 for embodiments where an audio signal or electrical current is provided to the speaker member 30.

In some embodiments, the speaker apparatus 28 may comprise a rotational wiring connector that inhibits the wiring from becoming wound or twisted. In these embodiments, the speaker member 30 may be permitted to rotate beyond a 360 degree range relative to the outer housing 34. Finally, as will be discussed below, the speaker member 30 is not required to be indexed, i.e., rotated to any particular angle, before being extended or retracted.

Figure 3:
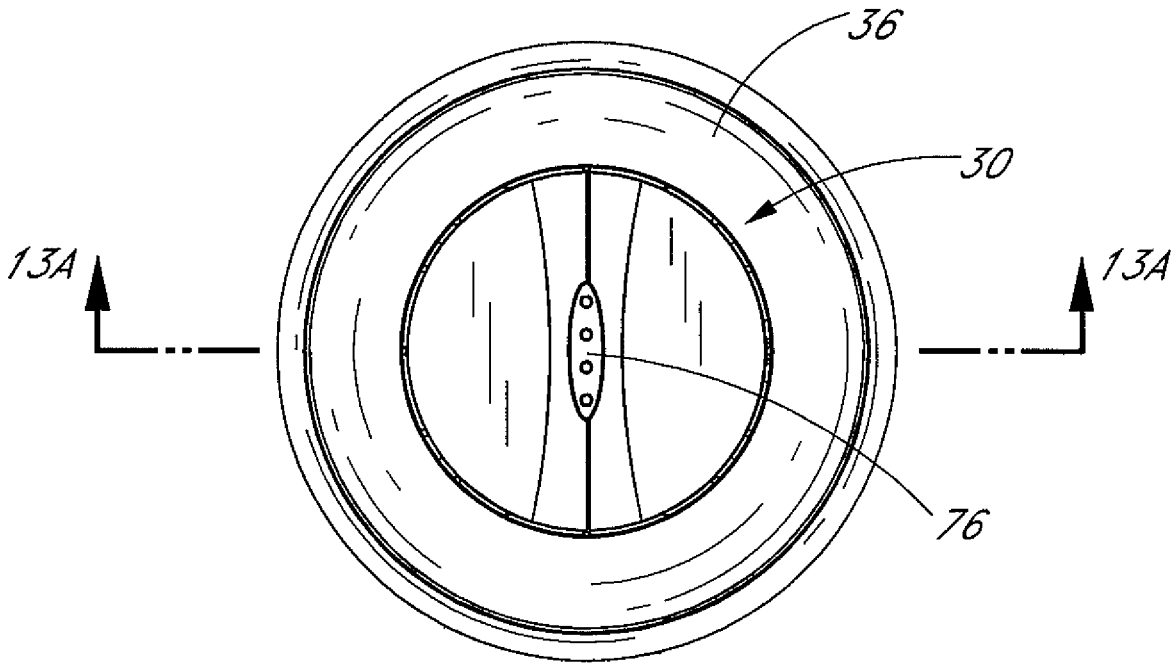
FIG. 3 is a top plan view of the speaker from FIG. 1 in the retracted position.
Figure 4:
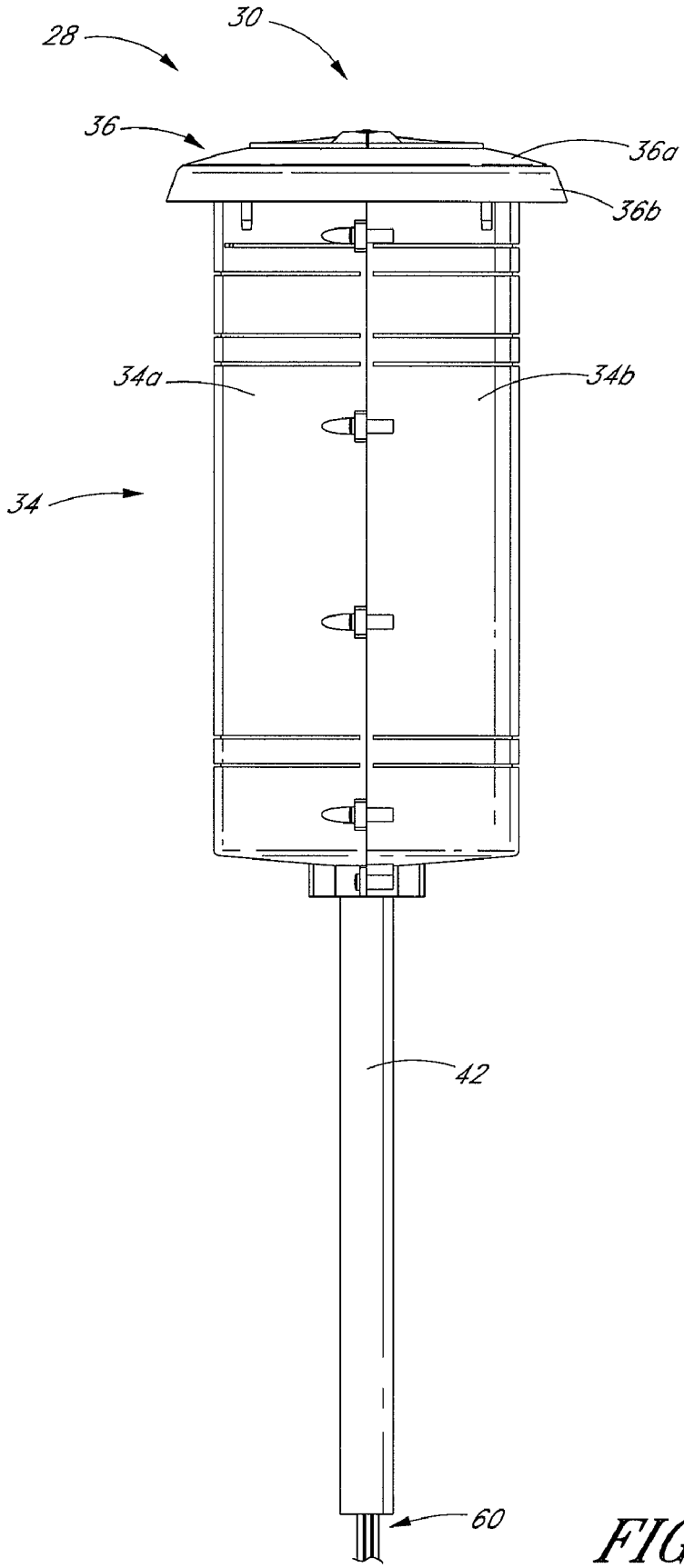
FIG. 4 is a side view of the speaker from FIG. 1 in the retracted position.
Figure 5:
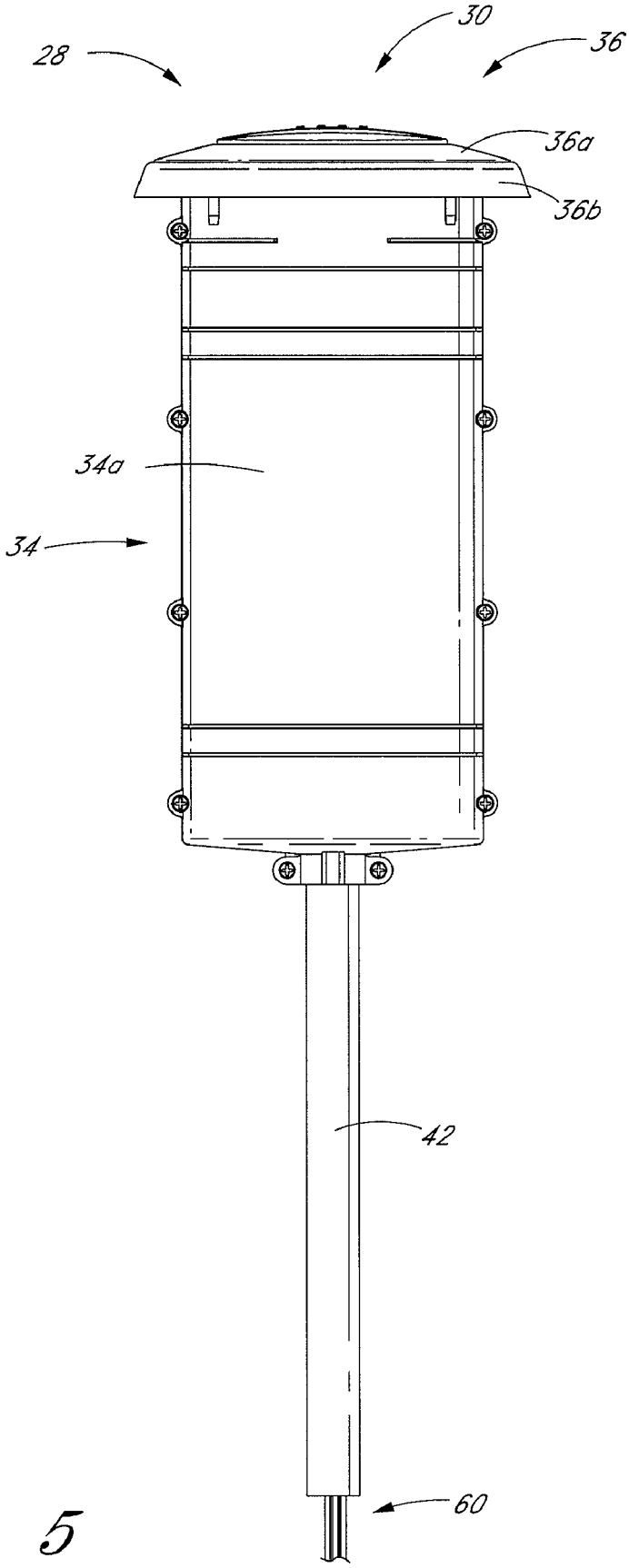
FIG. 5 is another side view of the speaker from FIG. 1.
Figure 6:
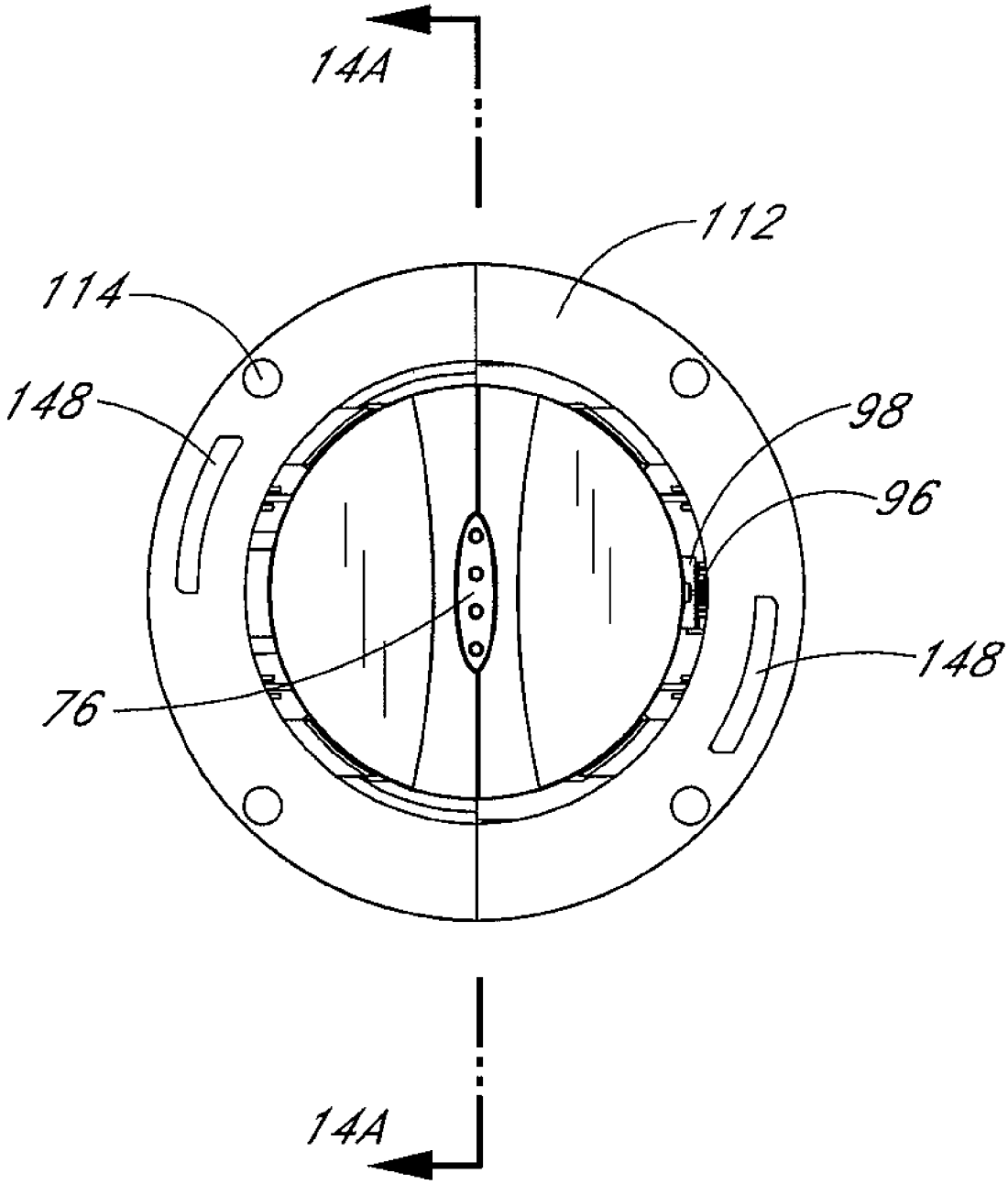
FIG. 6 is a top plan view of the speaker from FIG. 1 with a seal cover removed to show a flange that has a plurality of through-holes for receiving suitable fasteners.
Figure 7:
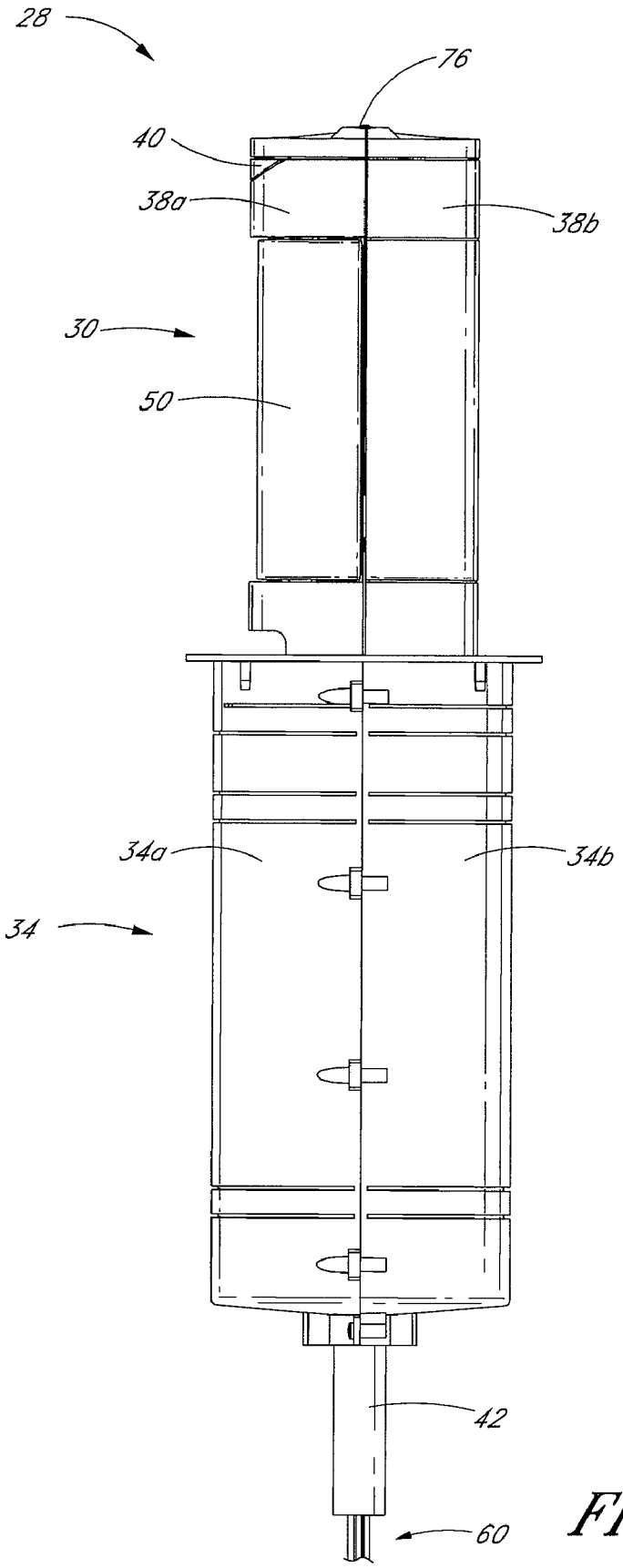
FIG. 7 is a view of the speaker from FIG. 4 in the extended position.
Figure 8:
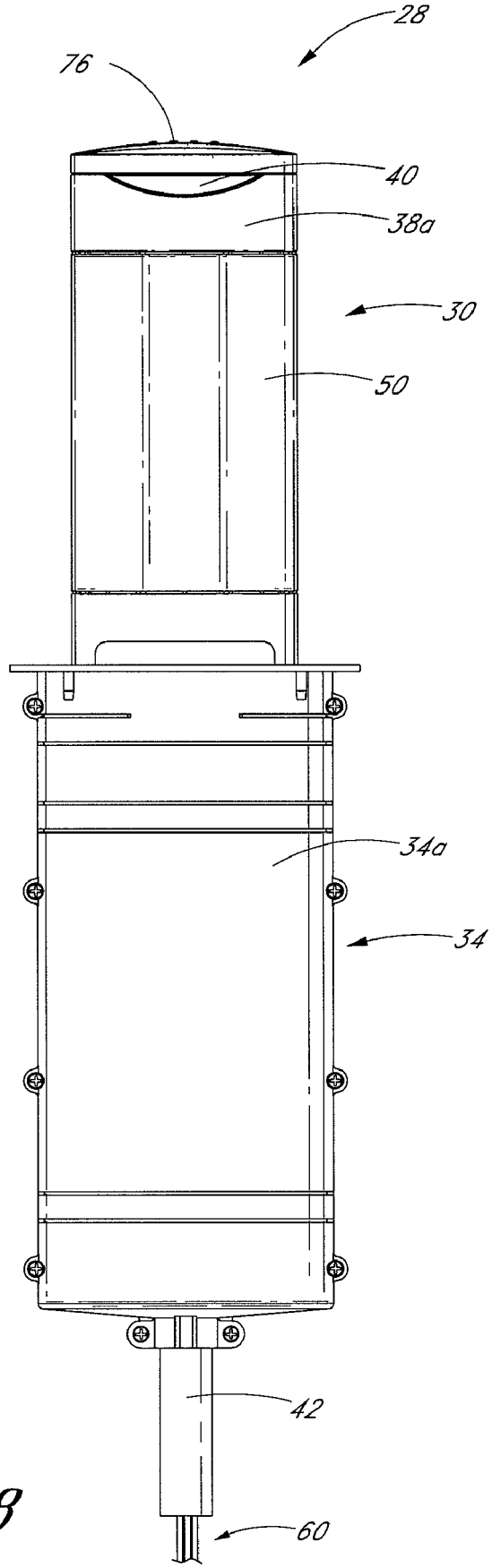
FIG. 8 is a view of the speaker from FIG. 5 in the extended position.

FIG. 3 is a top plan view of the speaker 28 from FIG. 1 in the retracted position. FIG. 4 is a side view of the speaker 28 from FIG. 1 in the retracted position. FIG. 5 is another side view of the speaker 28 from FIG. 1. FIG. 6 is a top plan view of the speaker 28 from FIG. 1 with a seal cover 36 removed to show a flange that has a plurality of through-holes 114 for receiving suitable fasteners. FIG. 7 is a view of the speaker 28 from FIG. 4 in the extended position. FIG. 8 is a view of the speaker 28 from FIG. 5 in the extended position.

Figure 9A:
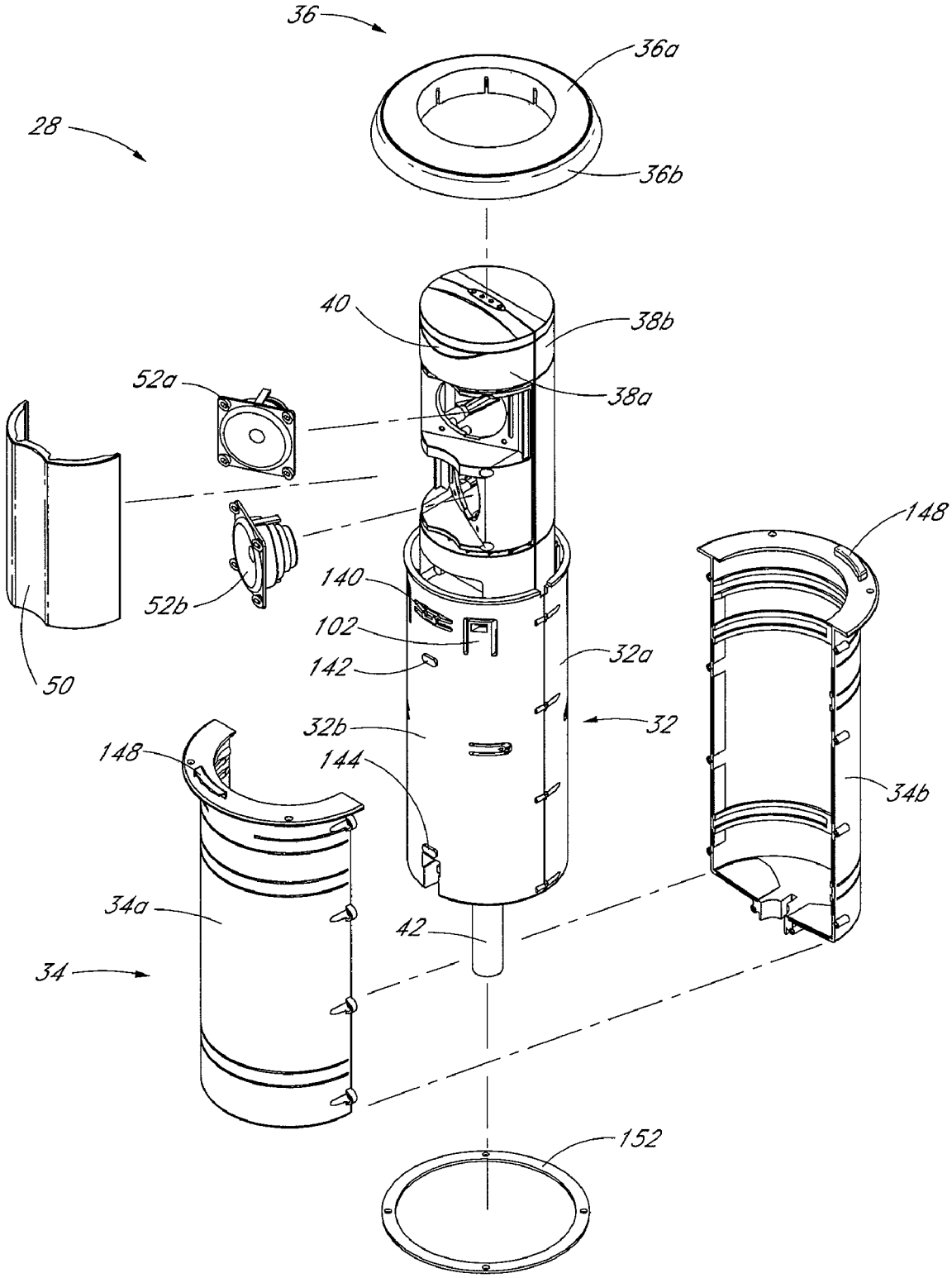
FIG. 9A is a partially exploded assembly view of the speaker from FIG. 1 showing a speaker member and a middle housing within an outer housing.
Figure 9B:
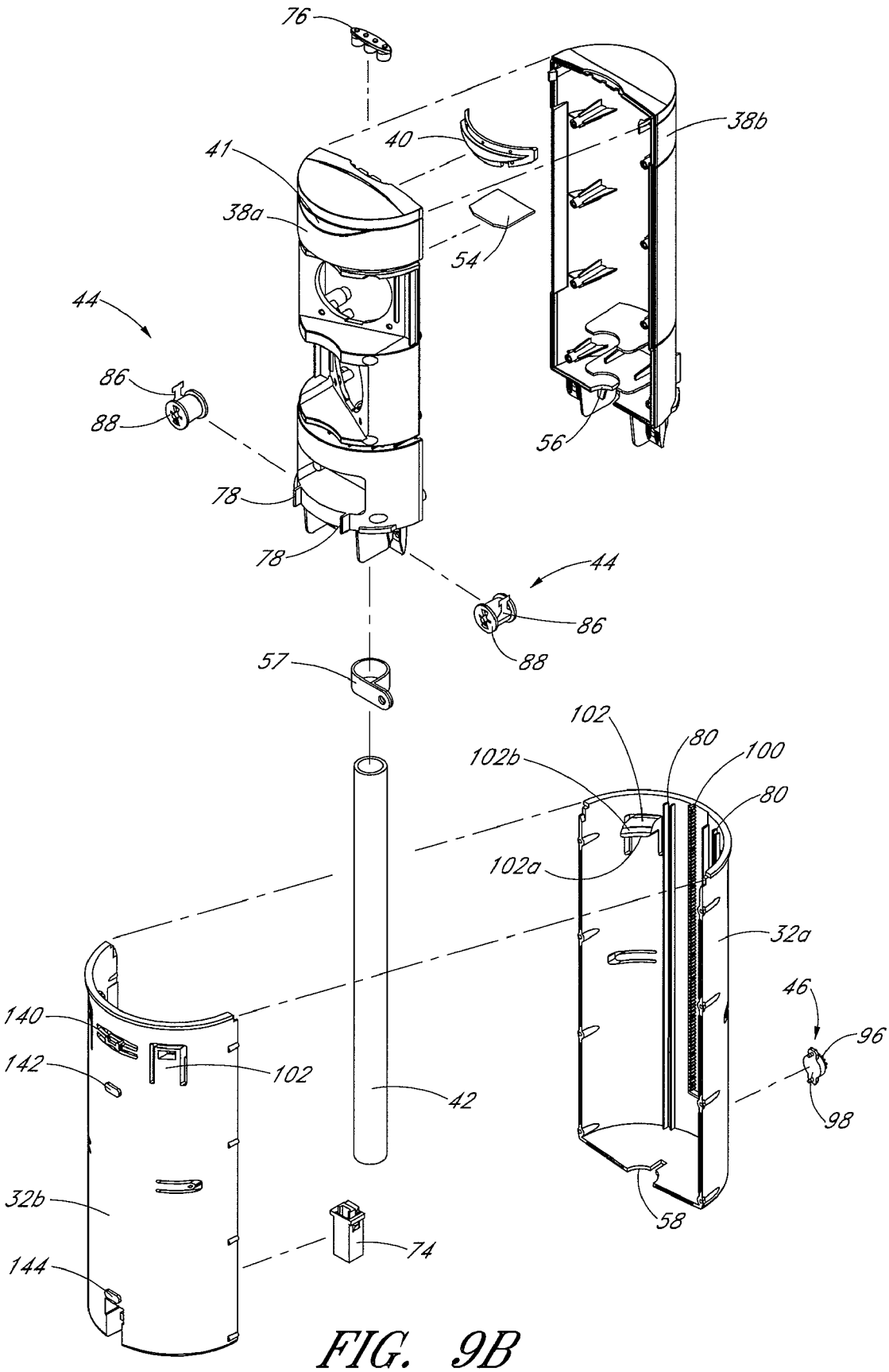
FIG. 9B is an exploded assembly view of the speaker member and middle housing from FIG. 9A.

FIG. 9A is a partially exploded assembly view of the speaker 28 from FIG. 1 showing a speaker member 30 and a middle housing 32 within an outer housing 34. FIG. 9B is an exploded assembly view of the speaker member 30 and middle housing 32 from FIG. 9A.

Figure 11A:
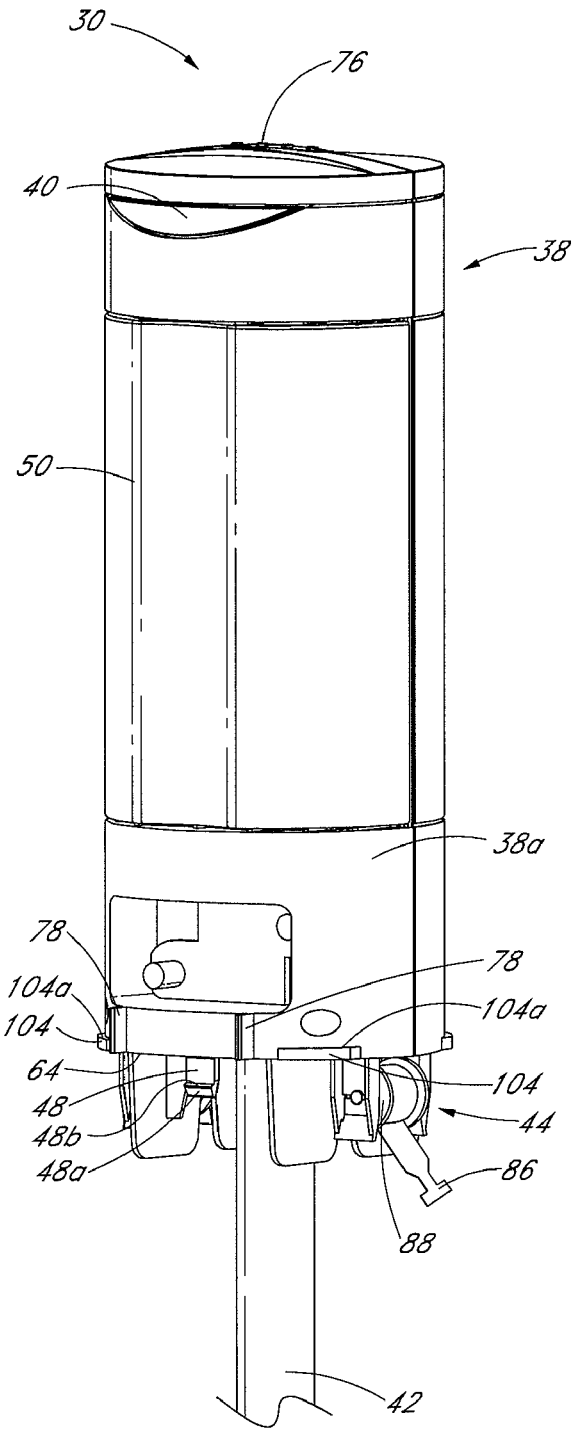
FIG. 11A is a perspective view of the speaker member from FIG. 9A showing generally the front of the speaker member.
Figure 11B:
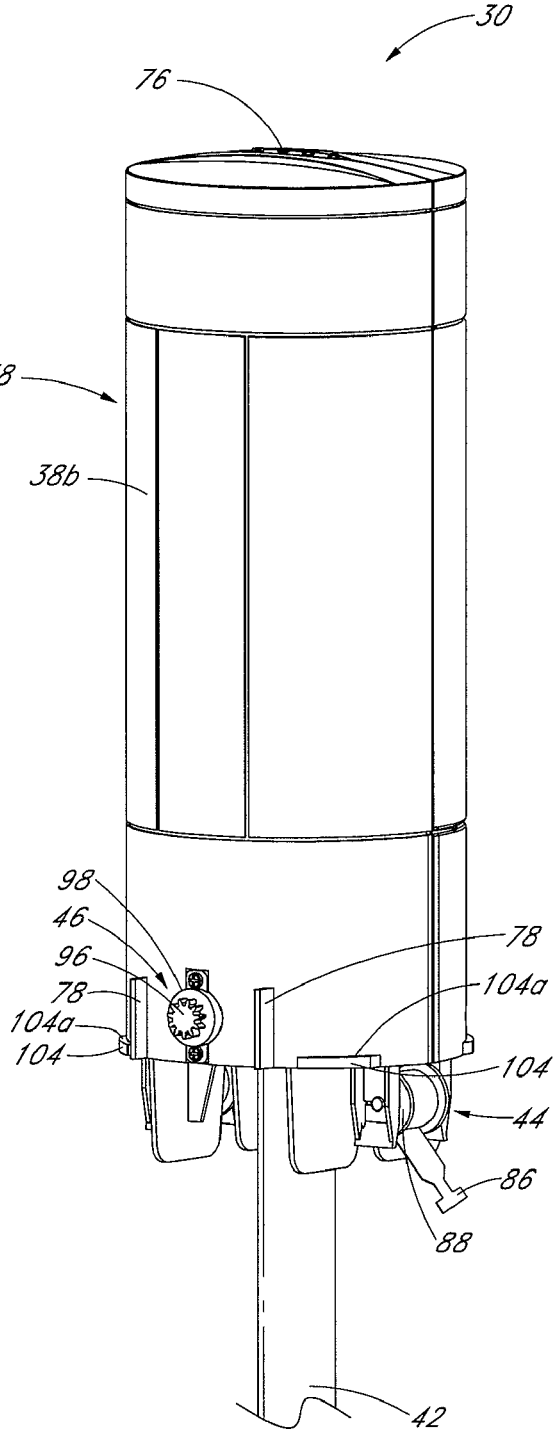
FIG. 11B is a perspective view of the speaker member from FIG. 9A showing generally the back of the speaker member.

FIG. 11A is a perspective view of the speaker member 30 from FIG. 9A showing generally the front of the speaker member 30. FIG. 11B is a perspective view of the speaker member 30 from FIG. 9A showing generally the back of the speaker member 30. In the illustrated embodiments, the speaker member 30 preferably comprises a speaker housing 38, a signal receiver or signal detector 40, a mounting post 42, one or more spring members 44, a damping mechanism 46, a latch prong 48, a grill 50, and other features or components that will be described below.

Figure 12:
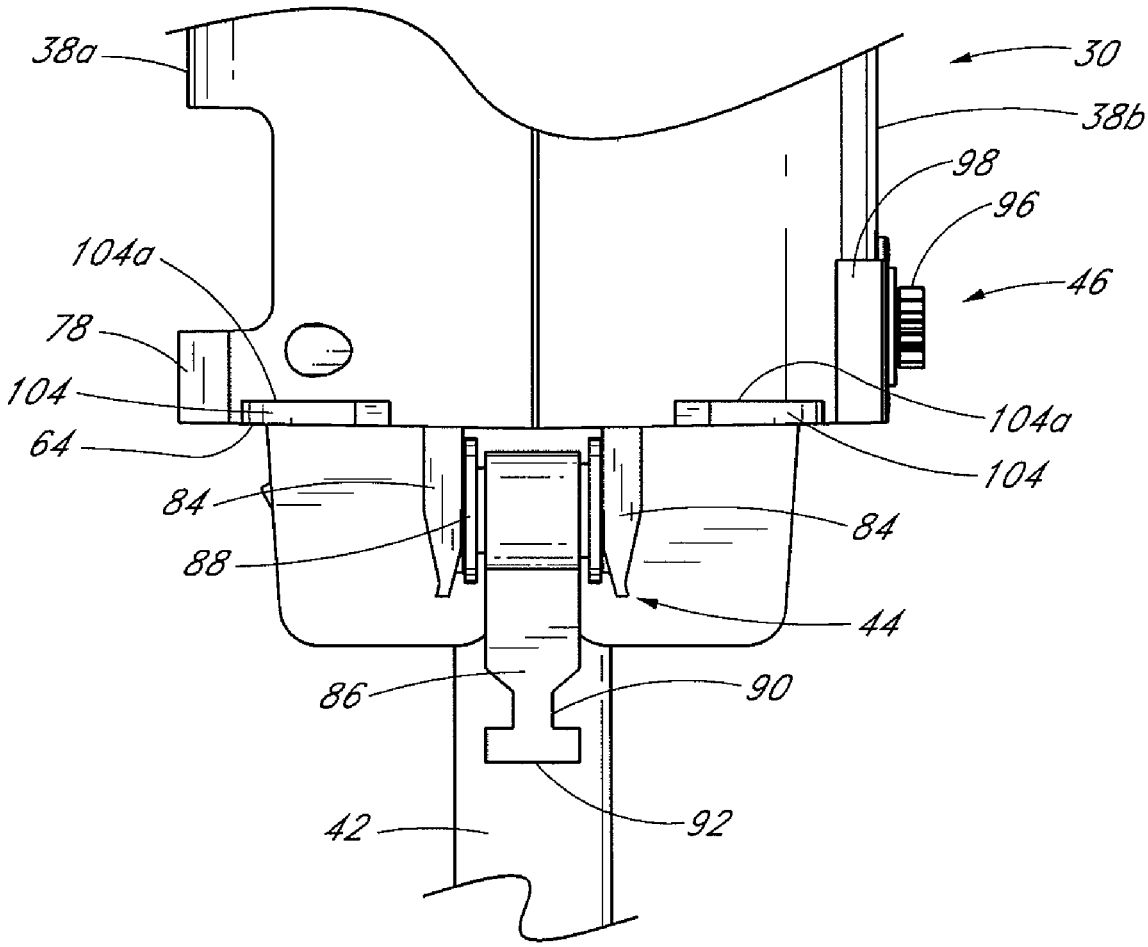
FIG. 12 is an enlarged side view of a lower portion of the speaker member from FIG. 11A.
Figure 13A:
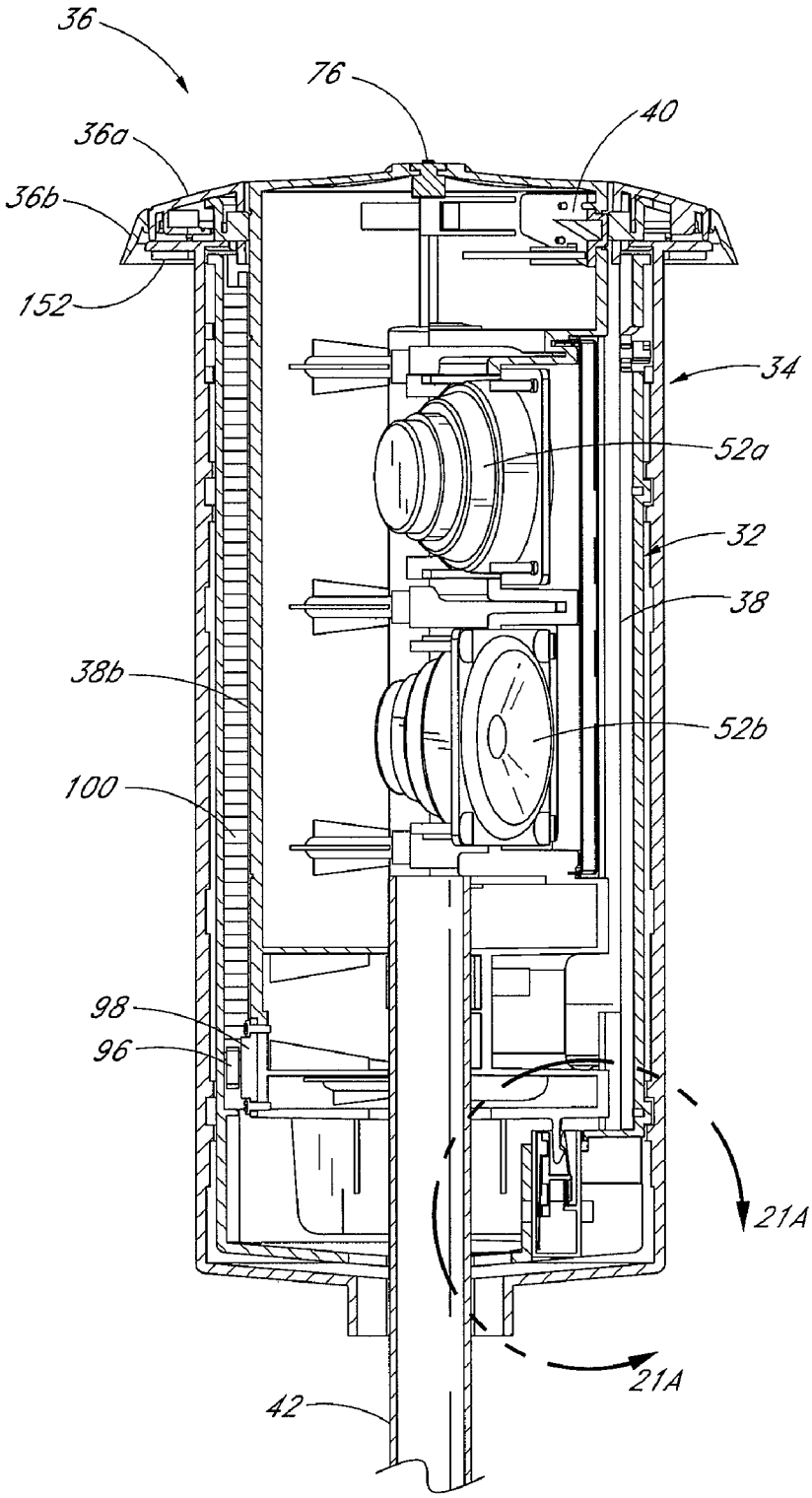
FIG. 13A is a section view of the speaker taken along line 13A-13A in FIG. 3.
Figure 13B:
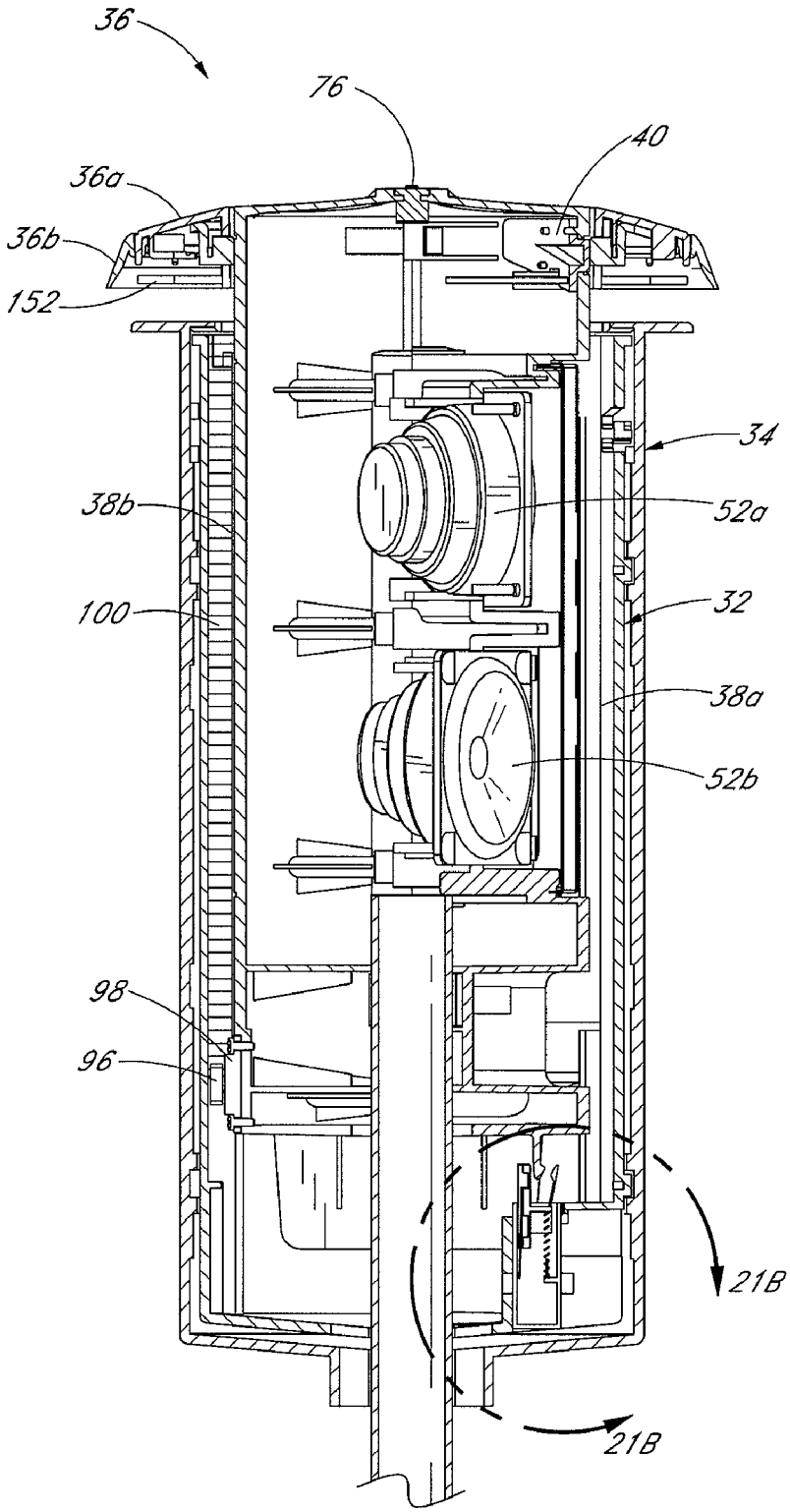
FIG. 13B is a view similar to FIG. 13A except that the speaker is in a partially extended position.
Figure 13C:
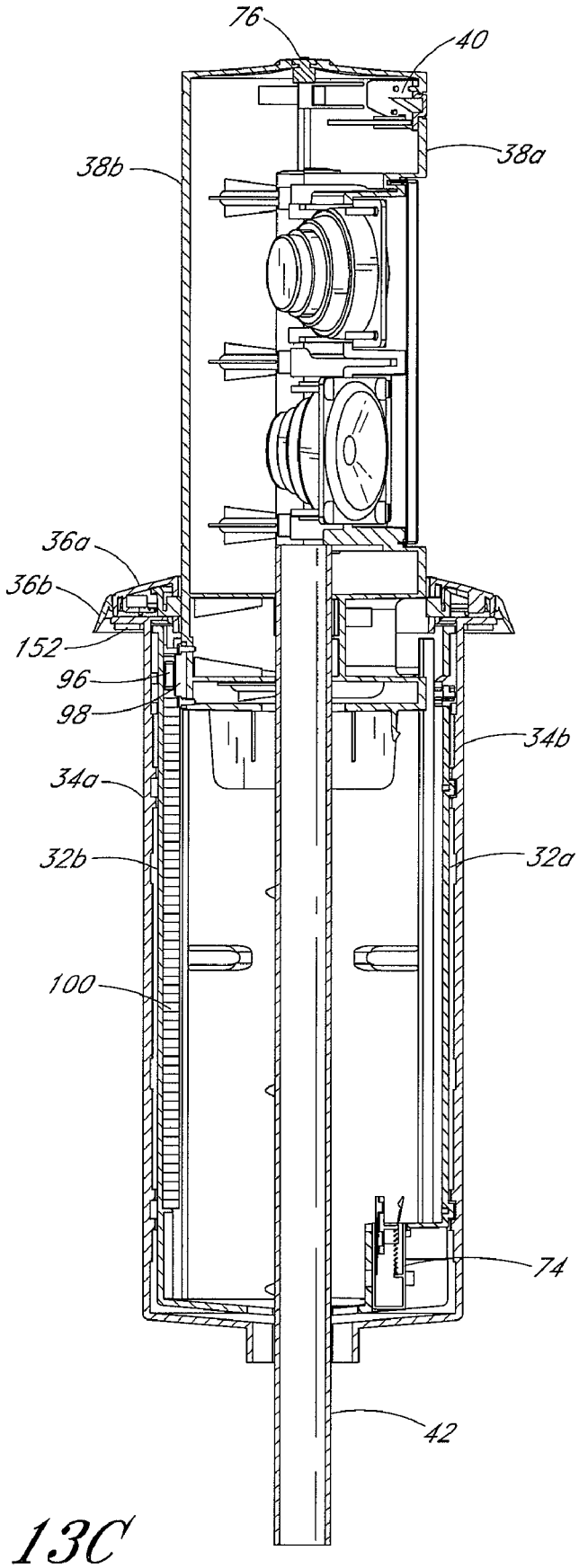
FIG. 13C is a view similar to FIG. 13B except that the speaker is in a fully extended position.

FIG. 12 is an enlarged side view of a lower portion of the speaker member 30 from FIG. 11A. FIG. 13A is a section view of the speaker 28 taken along line 13A-13A in FIG. 3. FIG. 13B is a view similar to FIG. 13A except that the speaker 28 is in a partially extended position. FIG. 13C is a view similar to FIG. 13B except that the speaker 28 is in a fully extended position.

Figure 14A:
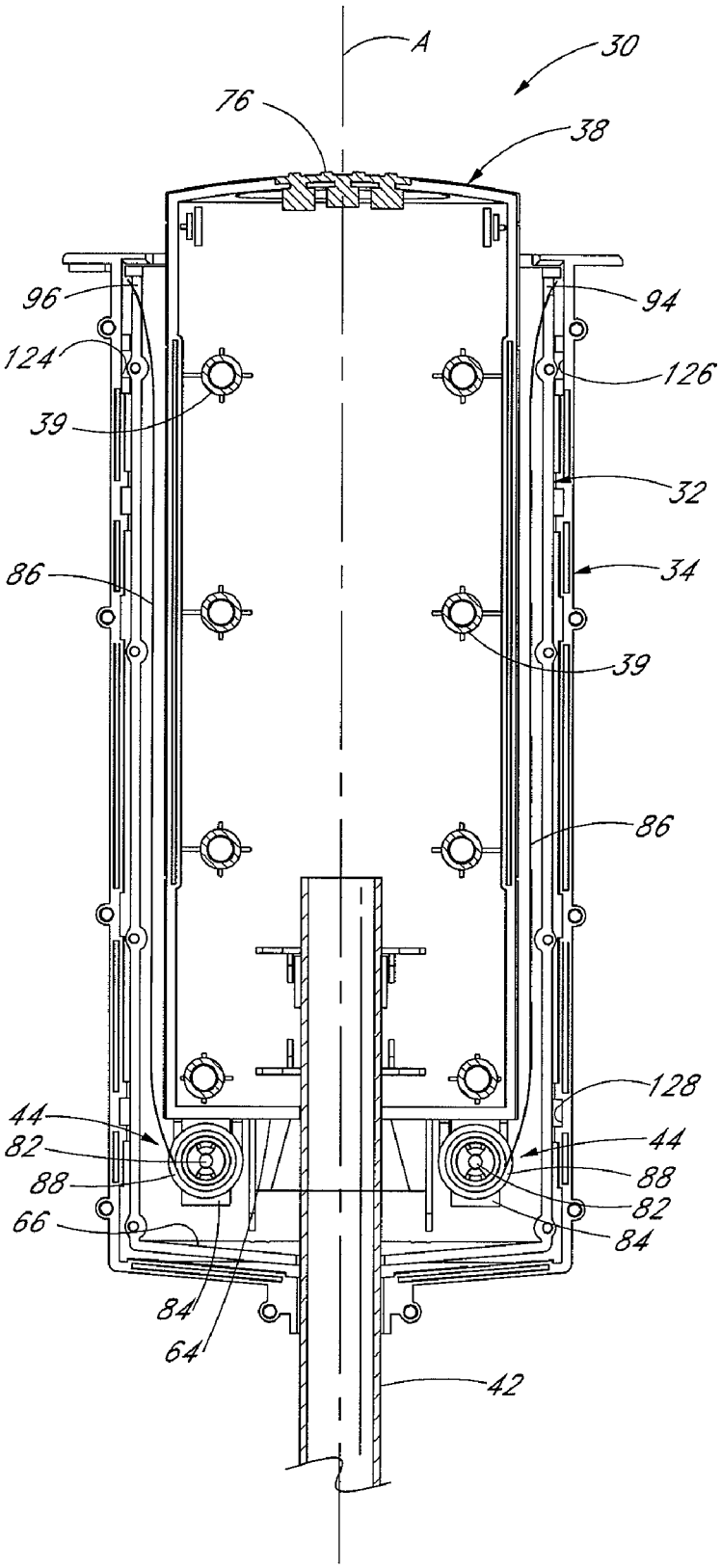
FIG. 14A is a section view of the speaker taken along line 14A-14A in FIG. 6 and shows the speaker member in a retracted position with the cover removed.
Figure 14B:
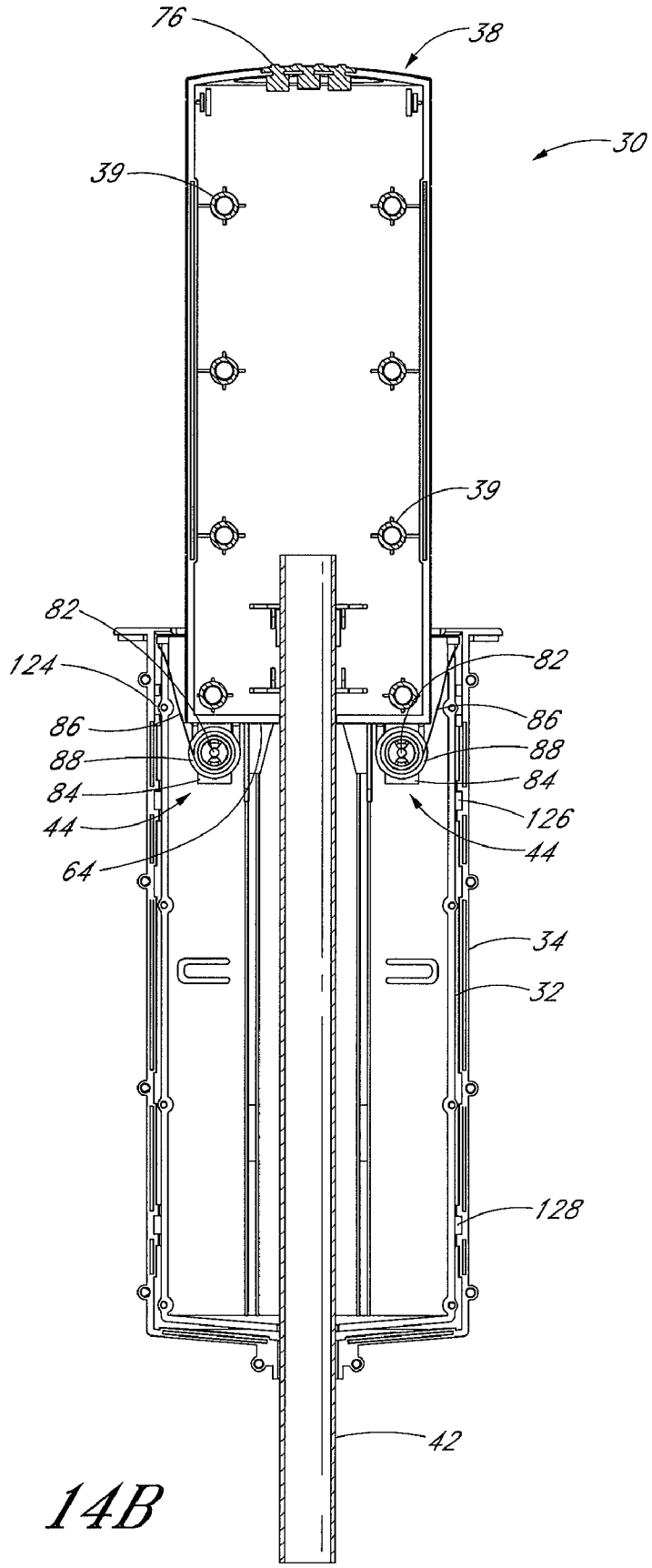
FIG. 14B is a view similar to FIG. 14A except that the speaker member is in the extended position.

FIG. 14A is a section view of the speaker 28 taken along line 14A-14A in FIG. 6 and shows the speaker member 30 in a retracted position with the cover 36 removed. FIG. 14B is a view similar to FIG. 14A except that the speaker member 30 is in the extended position. The speaker housing 38 includes a first speaker housing member 38*a* and a second speaker housing member 38*b*. As illustrated in FIGS. 14A and 14B, the first and second speaker housing members 38*a*, 38*b* are preferably attached to one another with screws or other fastener means. However, any other suitable fasteners or fastening method may be used to attach the first and second speaker housing members 38*a*, 38*b* together, including, without limitation, rivets, adhesive, or plastic welding. In the illustrated embodiments, the screws preferably pass through an unthreaded boss formed on the first speaker housing member 38*a*, and are then threadably inserted into each threaded boss 39 formed on the second speaker housing member 38*b*.

Further, as most clearly shown in FIG. 13A, the speaker housing 38 is configured to receive one or more audio drivers. In the illustrated embodiment, the speaker member 30 includes two high efficiency audio drivers 52*a,b* mounted therein. The upper audio driver 52*a* may be mounted above the lower audio driver 52*b* such that a vertical plane bisecting the upper audio driver 52*a* is oriented at an angle that is approximately 25° relative to a vertical plane A that bisects the front of the speaker member 30. Conversely, the lower audio driver 52*b* is preferably mounted such that a vertical plane bisecting the lower audio driver 52*b* is oriented at an angle that is approximately 25° in the opposite direction as compared to that of the upper audio drive 52*a* and relative to the plane A. Thus, in this configuration, the vertical plane bisecting the upper audio driver 52*a* is offset approximately 50° relative the plane that bisects the lower audio driver 52*b*.

In some embodiments, the upper audio driver 52*a* is preferably mounted above the lower audio driver 52*b* such that a plane bisecting the upper audio driver 52*a* is oriented at an angle that is less than approximately 25°, or approximately 25° to approximately 35°, or approximately 35° to approximately 45°, or more than or approximately 45°, relative to a plane A that bisects the speaker member 30. In some embodiments, the lower audio driver 52*b* is mounted such that a plane bisecting the lower audio driver 52*b* is oriented at an angle that is less than approximately 25°, or approximately 25° to approximately 35°, or approximately 35° to approximately 45°, or more than or approximately 45°, in the opposite direction as compared to that of the upper audio drive 52*a* relative to a plane A that bisects the speaker member 30.

As most clearly shown in FIG. 9A, the grill 50 is preferably vertically supported by the first speaker housing member 38*a* with the distal ends of the grill 50 contacting the back speaker housing member 38*b*. The grill 50 is preferably configured to cover and protect the audio drivers 52*a,b* from exposure to water, chemicals, sunlight, and impacts from other objects while allowing sound from the audio drivers 52*a,b* to pass through the grill 50.

As most clearly shown in FIG. 9B, the signal detector 40 is positioned in an opening 41 in an upper portion of the first speaker housing member 38*a*. The signal detector 40 receives wireless control signals. The control signals may be infrared signals or other wireless communications signals. The control signals allow a user to remotely control the audio functions of the speaker apparatus 28 and/or other audio components connected to the speaker 28. In some embodiments, the signal detector 40 receives infrared signals or other wireless communications signals to allow the user to remotely control certain functions related to the operation of the spa, pool, hot tub, bathtub, or other related components. The speaker 28 may include a printed circuit board 54 or other circuitry connected to the signal detector 40. The printed circuit board 54 may be mounted to the first speaker housing member 38*a* and operatively connected to the signal detector 40 to receive control signals so that the user may control the speaker 28 and/or related components.

As most clearly shown in FIG. 9B, the mounting post 42 is fastened to the inside of the speaker housing 38. The mounting post 42 protrudes through a speaker housing aperture 56 formed in the bottom portion of the speaker housing 38. The mounting post 42 is preferably configured to provide a lower bearing surface against which the speaker member 30 is rotated.

A retainer clip 57 may be used to hold the mounting post 42 in place. As such, the mounting post 42 and speaker housing 38 are preferably fixed together such that the mounting post 42 and speaker housing 38 rotate and translate axially together. The mounting post 42 is preferably cylindrical and configured such that it is free to rotate and translate axially through a middle housing aperture 58 in the bottom of the middle housing 32.

The speaker member 30 rotates and translates axially relative to the middle housing 32 and outer housing 34. In some embodiments, the mounting post 42 preferably protrudes approximately ten to twelve inches below the bottom surface 64 of the speaker housing 38. The mounting post 42 is also preferably configured to provide a conduit through which the audio and electrical wires 60 may be routed. For example, the electrical wires 60 may be routed through the post 42 and to the printed circuit board 54, signal detector 40, and/or audio drivers 52*a,b*. The audio and electrical wires 60 can be terminated in locking connectors within the speaker apparatus 28 to ensure the integrity of their connections.

Figure 21A:
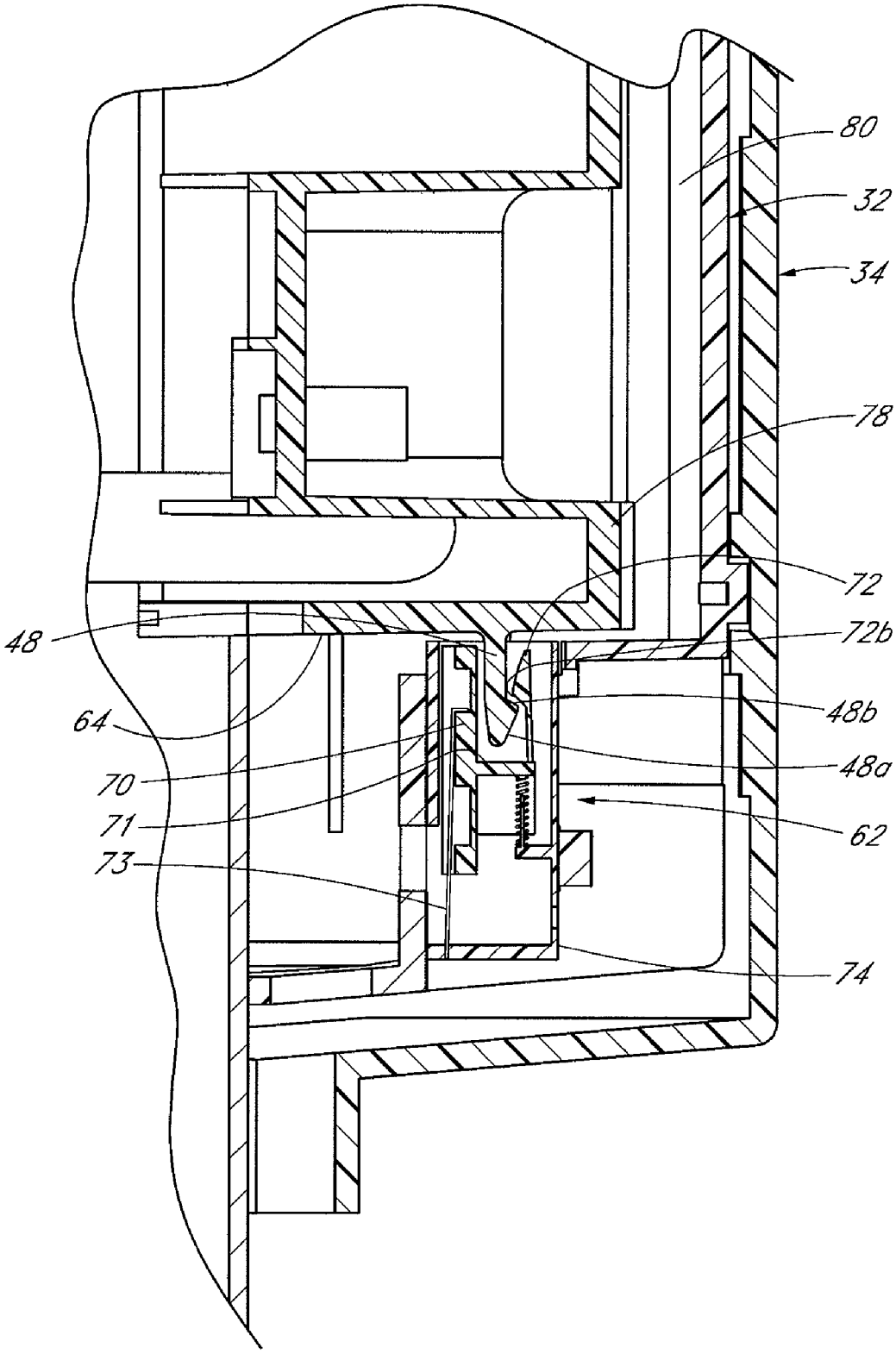
FIG. 21A is an enlarged view of a lower portion of the speaker taken along 21A-21A in FIG. 13A and shows a latch mechanism with the speaker in a retracted position.
Figure 21B:
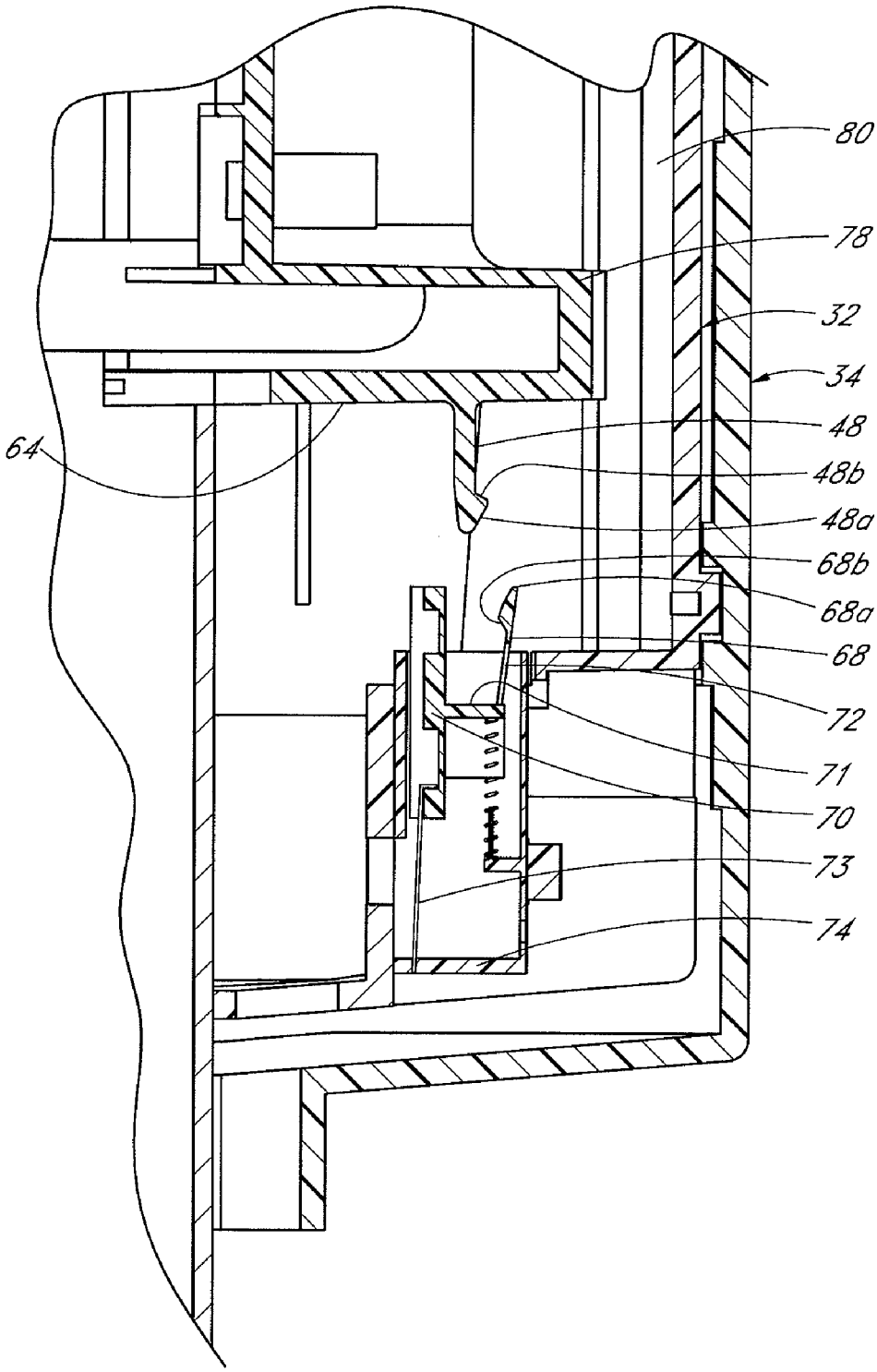
FIG. 21B is an enlarged view of a lower portion of the speaker taken along 21B-21B in FIG. 13B and shows the latch mechanism with the speaker in a partially extended position.

With reference to FIGS. 11A, 21A, and 21B, the latch prong 48 and latch mechanism 62 will now be described. In the illustrated embodiment, the latch mechanism 62 is located on the inside, bottom surface 66 of the second middle housing member 32*b*. The latch prong 48 protrudes in a downward direction from the bottom surface 64 of the first speaker housing member 38*a*. When the fully retracted speaker member 30 is depressed by the user with respect to the outer housing 34, the latch prong 48 is released from the latch mechanism 62. In this way, the push-push latch mechanism 62 communicates with the latch prong 48 of the first speaker housing member 38*a*. Although the term "push-push latch mechanism" is used throughout this description, it is to be understood that any suitable latching mechanism can be used to releasably secure the speaker member 30 in the retracted position. Accordingly, as used herein, the term "push-push latch mechanism" is to be understood to represent any suitable latch mechanism.

The latch prong 48 protrudes from the bottom surface 64 of the first speaker housing member 38*a*. The latch mechanism 62 is preferably configured to releasably secure the speaker member 30 in the retracted position. As most clearly shown in FIGS. 21A and 21B, the latch prong 48 comprises an inclined surface 48*a* and an abutment surface 48*b*. In the illustrated embodiments, the push-push latch mechanism 62 preferably comprises a latch mechanism prong 68 and latch mechanism guide 70. The latch mechanism guide 70 translates into and out of a latch mechanism cavity 72 in a latch housing 72.

The latch mechanism prong 68 is preferably integrally formed with the latch mechanism guide 70 so as to define a single, integral part. The latch mechanism prong 68 is preferably configured to be flexible at or near its base so that it can rotate relative to the latch mechanism guide 70. Further, the latch mechanism prong 68 is preferably configured to comprise features that are complementary to the inclined surface 48*a* and an abutment surface 48*b* on the latch prong 48 to guide the latch prong 48 into the latch mechanism 62 as the speaker member 30 moves toward the retracted position. As will be discussed, the latch mechanism prong 68 is also preferably configured to releasably secure the latch prong 48 in the latch mechanism 62 when the speaker member 30 is in the retracted position.

As most clearly illustrated in FIG. 21A, when the speaker member 30 is in the retracted position such that the latch prong 48 is substantially fully inserted into the latch mechanism 62, the latch mechanism 62 is preferably configured to releasably secure the latch mechanism prong 68, the latch mechanism guide 70, and speaker member latch prong 48 in a closed position. When the speaker member 30 is in the extended or partially extended position such that the latch prong 48 is not inserted into the latch mechanism 62, the latch mechanism 62 is preferably biased to be in the open position, as illustrated in FIG. 21B. When the latch prong 48 is not inserted into the latch mechanism 62, i.e., when the latch mechanism 62 is in the open position, both the latch mechanism prong 68 and latch mechanism guide 70 are preferably biased upward, so as to extend partially out of the latch mechanism cavity 72. When the latch prong 48 is not inserted into the latch mechanism 62, the latch mechanism prong 68 is preferably biased such that the uppermost end of the latch mechanism prong 68 rotates away from the latch mechanism guide 70 (i.e., such that the inclined surface 68*a* of the latch mechanism prong 68 moves away from the latch mechanism guide 70). This rotation may create a larger space for receiving the latch prong 48 when the speaker member 30 is moved toward the retracted position.

In the illustrated embodiment, as the latch prong 48 moves into the latch mechanism 62, the distal end of the latch prong 48 preferably contacts an abutting protrusion 71. The protrusion 71 is preferably rigidly attached to, or integrally formed with, and protruding from the latch member guide 70. Hence, as the distal end of the latch prong 48 pushes the abutting protrusion 71 in the downward direction, the latch member guide 70 and the latch mechanism prong 68 are preferably caused to retract into the latch mechanism cavity 72 and to close toward one another, securing the latch prong 48 within the latch mechanism 62. A preferably thin, rigid metal arm 73 communicates with the latch member guide 70 to selectively secure the guide in either the open or closed position.

In the illustrated embodiments, to move the speaker member 30 into the retracted position, such that the latch mechanism 62 is moved to the closed position (as illustrated in FIG. 21A), the user preferably applies a downward force to the top of the speaker member 30 sufficient to overcome the upward biasing force of the spring members 44. The downward force is sufficient to cause the speaker member latch prong 48 to insert into the latch mechanism 62. The inclined surfaces 48*a* and 68*a* of the speaker member 30 latch prong 48 and latch mechanism prong 68, respectively, preferably help to guide the speaker member 30 latch prong 48 into the latch mechanism 62. In the illustrated embodiments, a rubber grip member 76 can be attached to the upper portion of the speaker member 30 to provide a gripping surface for the user and, hence, to facilitate the retraction of the speaker member 30.

As described above, the insertion of the speaker member latch prong 48 into the latch mechanism 62 causes the latch mechanism prong 68 to move toward the closed position, i.e., causes the latch mechanism prong 68 to move toward the latch mechanism guide 70. When the latch mechanism 62 is in the fully retracted or closed position, as illustrated in FIG. 21A, the latch mechanism prong 68 and the latch mechanism guide 70 are releasably locked in the closed position until the user applies a subsequent downward force to the speaker member 30 which, as will be described, will cause the latch mechanism 62 to release the latch prong 48.

In the closed position, the speaker member 30 is preferably prevented from moving upward to the extended position by the overlap or engagement of the abutment surface 68*b* on the latch mechanism 62 and the abutment surface 48*b* on the speaker member latch prong 48*b*. When the speaker member 30 is in the closed position, a downward force imparted onto the speaker member 30 causes the latch mechanism 62 to move to the open position, releasing the speaker member latch prong 48.

In the illustrated embodiments, the speaker member 30 and middle housing 32 are preferably configured such that the speaker member 30 does not rotate relative to the middle housing 32. Of course the speaker member 30 could be configured to rotate relative to the middle housing 32 and not rotate relative to the outer housing 34 in other embodiments.

As most clearly shown in FIGS. 11A and 11B, the speaker member 30 comprises one or more fins 78. In the illustrated embodiment, the speaker member comprises four vertically oriented alignment fins 78. As most clearly shown in FIG. 9B, the fins 78 are disposed so as to slide within four vertically oriented alignment channels 80 formed on the inside surface of the speaker housing 38. In the illustrated embodiments, the alignment fins 78 and alignment channels 80 preferably prevent the speaker member 30 from rotating relative to the middle housing 32, thus ensuring that the latch prong 48 on the speaker member 30 is always in proper alignment for engagement with the latch mechanism 62. Thus, in the illustrated embodiments, the user is not required to rotationally orient, or index, the speaker member 30 before securing the speaker member 30 in the retracted position. Further, because the speaker member 30 and middle housing 32 are preferably free to rotate relative to the outer housing 34 or within a predetermined range, and because the outer housing 34 is preferably fixed to the spa surface, the speaker member 30 can be positioned in multiple radial orientations relative to the outer housing 34 or spa when it is being retracted or extended.

When the latch mechanism 62 is in the open position, as illustrated most clearly in FIG. 21B, the force of the spring members 44 on the speaker member 30 preferably biases the speaker member 30 toward the extended position relative to the middle housing 32. As illustrated most clearly in FIGS. 12, 14A, and 14B, each of the two diametrically opposed spring members 44 can be mounted on, and freely rotate about, a pin 82. The pin 83 is preferably mounted between a pair of tabs 84 protruding from the bottom surface 64 of the speaker housing. As such, the spring members 44 preferably freely rotate about the pins 82, but are preferably axially constrained by the tabs 84.

Each spring member 44 may include a roll spring 86. Each roll spring 86 is supported at its proximal end by a spool 88. Each spool is preferably supported by each pin 82 and axially constrained by each pair of tabs 84.

As most clearly shown in FIGS. 12, 14, 14B, and 19, the distal end of each roll spring 86 is preferably secured to an upper portion of the middle housing 32. In particular, the distal end of each roll spring 86 preferably comprises a constricted portion 90 and a flared portion 92. The distal end of each roll spring 86 can be latched into a cutout 94 preferably formed at an upper portion of the middle housing 32. The width of each cutout 94 is preferably slightly larger than the width of each constricted portion 90, but preferably substantially less than the width of each flared portion 92 so that the distal end of each roll spring 86 can be inserted into, and secured by, each cutout 94.

When the speaker member 30 is in the retracted position, as illustrated in FIG. 14A, each roll spring 86 is substantially extended. When the speaker member 30 is in the extended position, as illustrated in FIG. 14B, each roll spring 86 is substantially retracted. In this configuration, each spring member 44 preferably exerts an approximately constant force on the speaker member 30, regardless of the position of the speaker member 30 relative to the middle housing 32, biasing the speaker member 30 toward the extended position.

As most clearly shown in FIGS. 9B, 11B, and 12, the speaker member 30 preferably also comprises a damping mechanism 46. The damping mechanism 46 preferably comprises a splined gear member 96 mounted to a bracket 98. As illustrated, the bracket 98 can be mounted to the second speaker housing member 38*b* by a pair screws. However, any other suitable fasteners or fastening method may be used to attach the bracket 98 to the second speaker housing member 38*b*, including, without limitation, rivets, adhesive, or plastic welding. In this configuration, the splined gear member 96 is free to rotate in a controlled manner relative to the bracket 98. The teeth or protrusions of the splined gear member 96 are preferably configured to engage with second middle housing member 32*b*. as is most clearly shown in FIG. 18, the teeth or protrusions of the splined gear member 96 may engage with corresponding teeth or protrusions of a splined channel 100 located on the inside surface of the second middle housing member 32*b*.

The damping mechanism 46 is preferably configured to control the rate of extension of the speaker member 30 after a user releases the speaker member 30 from the latch mechanism 62. Consequently, the damping mechanism 46 may also control the rate of retraction of the speaker member 30 when a user pushes the speaker member 30 down into the retracted position. The damping mechanism 46 facilitates the smooth and constant rate of movement of the speaker member 30 relative to the middle housing 32. The damping mechanism 46 may further reduce the magnitude of the impact force between the speaker member 30 and the middle housing 32 when the speaker member 30 reaches its fully extended position.

As most clearly shown in FIG. 9B, the first middle housing member 32*a* and the second middle housing member 32*b* each preferably comprises a pair of abutment tabs 102. The tabs 102 protrude toward the inside of the middle housing 32. Further, as seen most clearly in FIGS. 11A and 11B, the first speaker housing member 38*a* and the second speaker housing member 38*b* each preferably comprises a pair of abutment tabs 104 that protrude away from the speaker housing 38.

Figure 18:
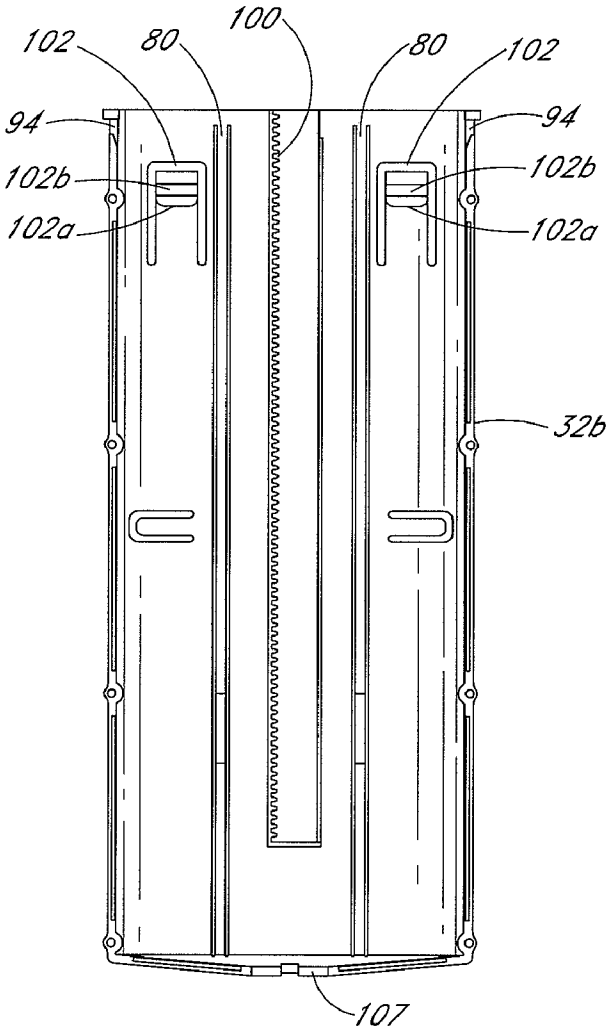
FIG. 18 is a side view of the inside of a second middle housing member from FIG. 9B.
Figure 17:
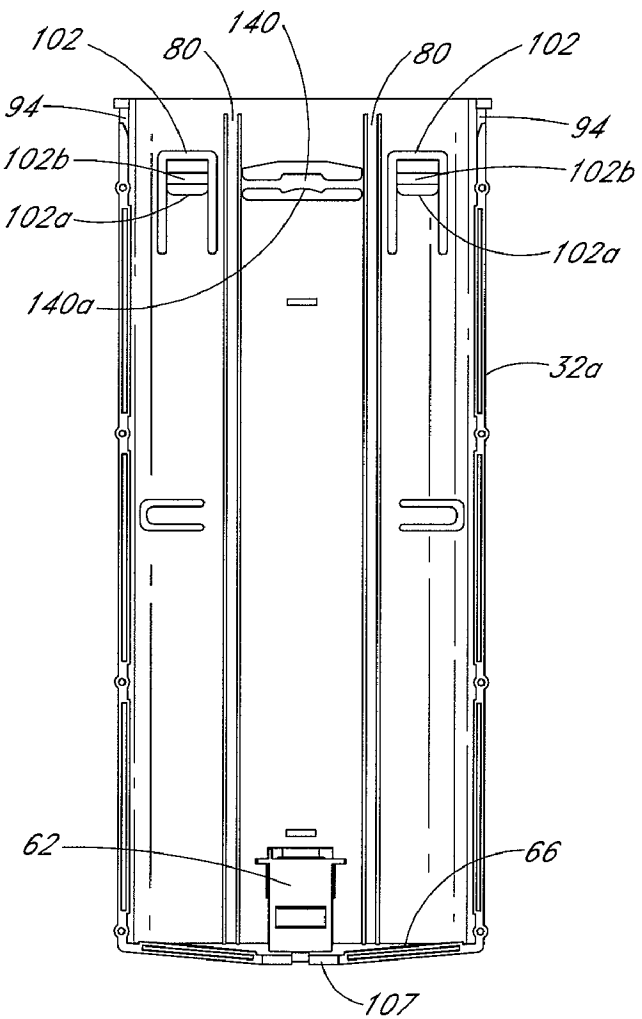
FIG. 17 is a side view of the inside of a first middle housing member from FIG. 9B.

In the illustrated embodiments, with reference to FIGS. 9B, 17, and 18, the abutment tabs 102 on the middle housing 32 preferably define an abutment surface 102*a* and a slide surface 102*b*. In this configuration, the abutment tabs 102 preferably provide two functions. First, the slide surface 102*b* of each abutment tab 102 provides a contact or slide surface against which the speaker housing 38 translates in the axial direction. As such, the slide surfaces 102*b* align the speaker housing 38 in the center of the middle housing 32. Additionally, each abutment surface 102*a* provides a mechanism for restricting the range of motion of the speaker member 30 in the axial direction when the speaker member 30 is being extended away from the middle housing 32. In particular, during the extension motion, when the speaker member 30 has moved a desired distance away from the bottom surface 66 of the middle housing 32, the abutment surfaces 102*a* preferably contact each abutment tab 104 on the speaker housing 38. In the fully extended position, each abutment surface 102*a* on the middle housing 32 overlaps and engages the abutment surface 104*a* of each abutment tab 104 on the speaker housing 38, preventing the speaker member 30 from extending any further upward from the bottom surface 64 of the middle housing 32.

Figure 19:
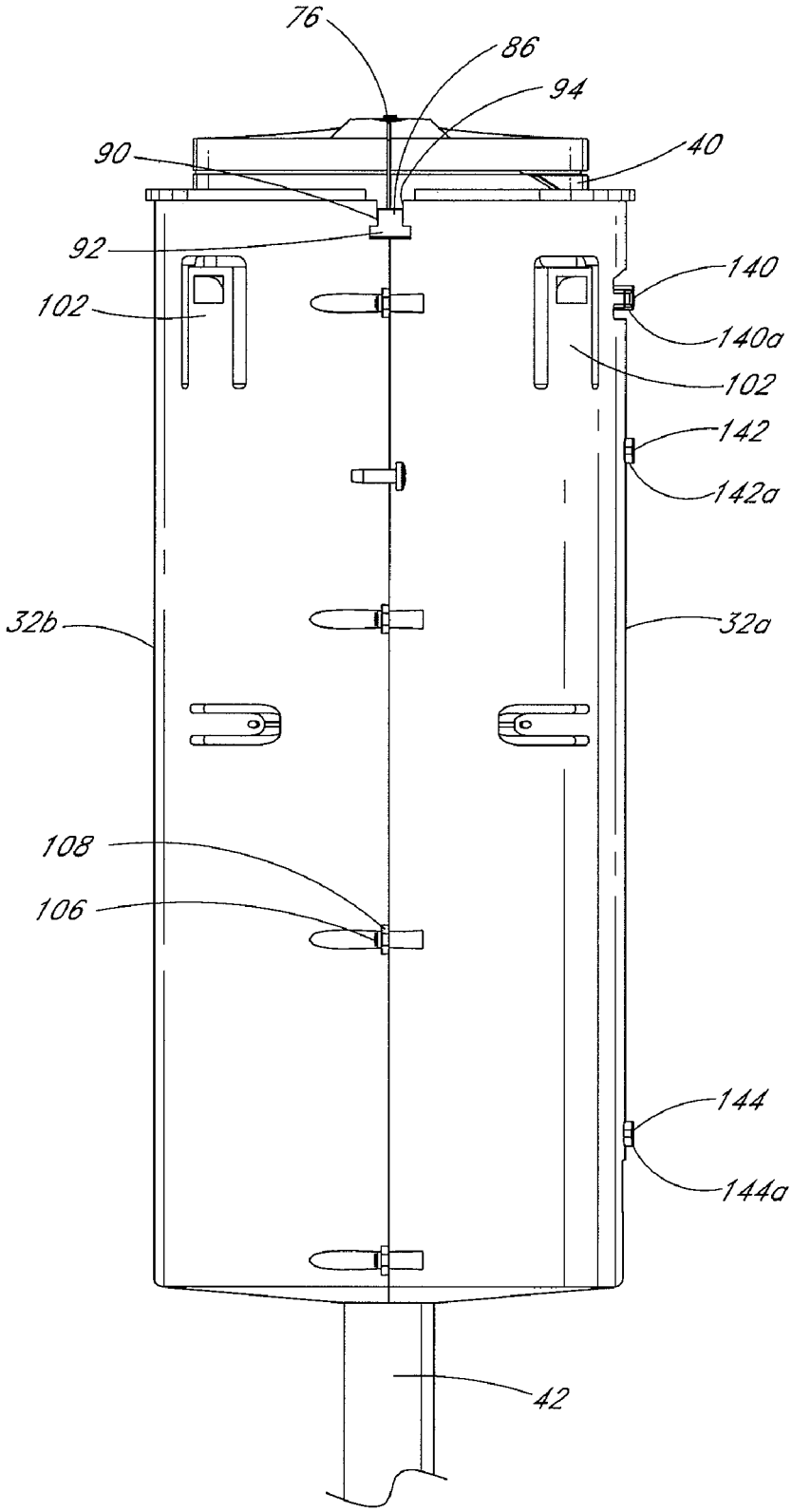
FIG. 19 is an enlarged side view of an upper portion of the speaker from FIG. 4 with the first and second outer housing members and the seal cover removed.
Figure 20:
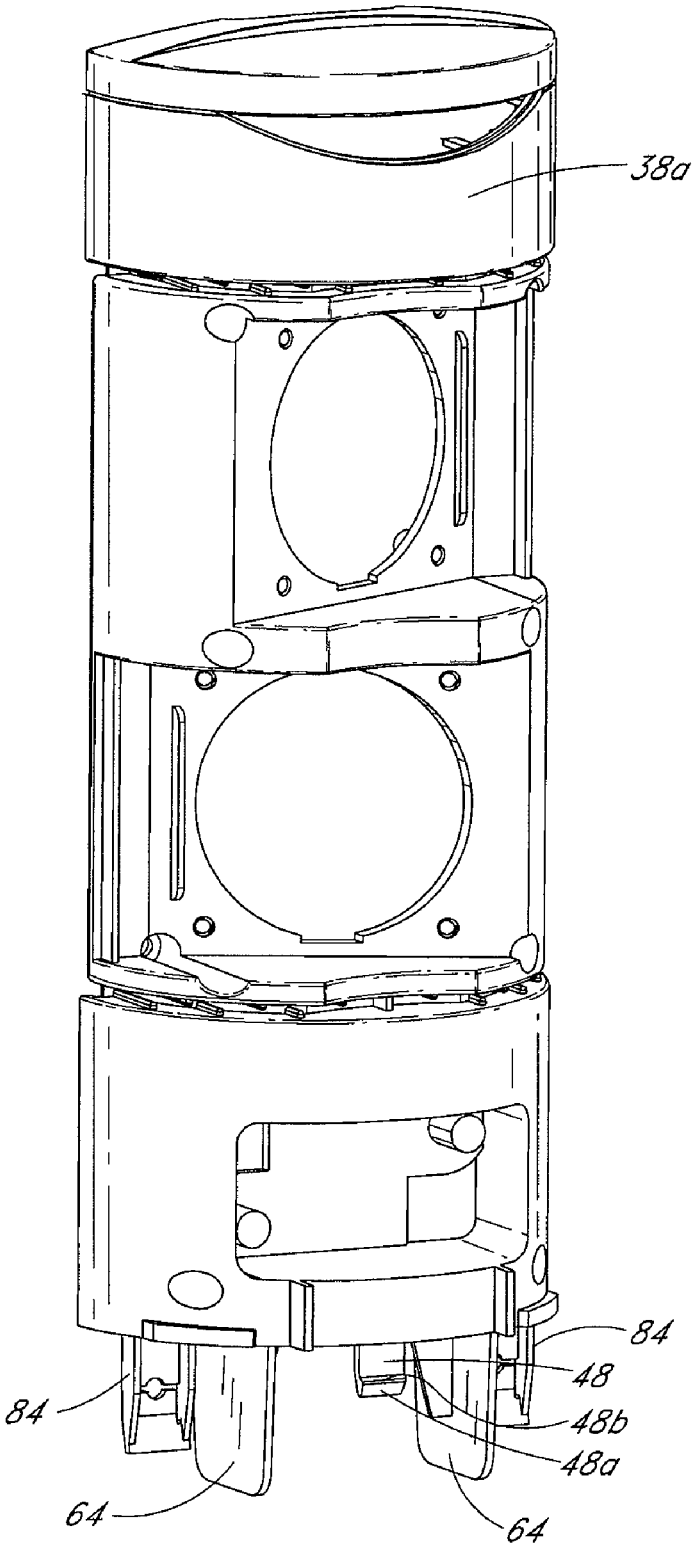
FIG. 20 is a perspective view of a first speaker housing member from FIG. 9B.

As illustrated in FIG. 19, the first and second middle housing members 32*a*, 32*b* are preferably attached to one another with screws 106. However, any other suitable fasteners or fastening method may be used to attach the first and second middle housing members 32*a*, 32*b* together, including without limitation rivets, adhesive, or plastic welding. In the illustrated embodiments, the screws 106 are preferably each passed through an unthreaded boss 108 formed on the outside surface of the second middle housing member 38*b*, and are each preferably threadably inserted into each threaded boss 110 formed on the outside surface of the first middle housing member 32*a*. Screws 106 are similarly used on the opposite side of the middle housing 32 to secure both sides of each middle housing member 32*a*, 32*b* together.

The middle housing 32 preferably comprises an aperture 107 at a lower portion of the middle housing 32. The aperture 107 is preferably configured to have a diameter that is slightly larger than the diameter of the mounting post 42 so that the mounting post 42 is free to translate axially through the aperture 107 without obstruction.

As stated, in the illustrated embodiments, the outer housing 34 preferably comprises a first outer housing member 34*a* and a second outer housing member 34*b*. The outer housing 34 preferably comprises an upper flange 112 which is preferably configured to be larger than the through-hole prepared in the desired mounting surface of the spa to prevent the speaker apparatus 28 from falling through the through-hole. In this configuration, a bottom surface of the flange 112 is supported by the upper surface of the spa surrounding the through-hole.

The flange 112 preferably has a plurality of apertures or holes 114 through which screws or other suitable fasteners can be passed. The fasteners are threadably inserted into the top surface of the spa. However, any other suitable fasteners or fastening method may be used to attach the outer housing 34 to the spa, including without limitation rivets or adhesive. Further, as with the first and second middle housing members 32*a*, 32*b*, the first and second outer housing members 34*a*, 34*b* may be joined together by any suitable fastening means, including threadably inserting screws through unthreaded bosses 118 formed on an outer surface of the first outer housing member 34*a* into threaded bosses formed on an outer surface of the second outer housing member 34*b*.

Figure 16:
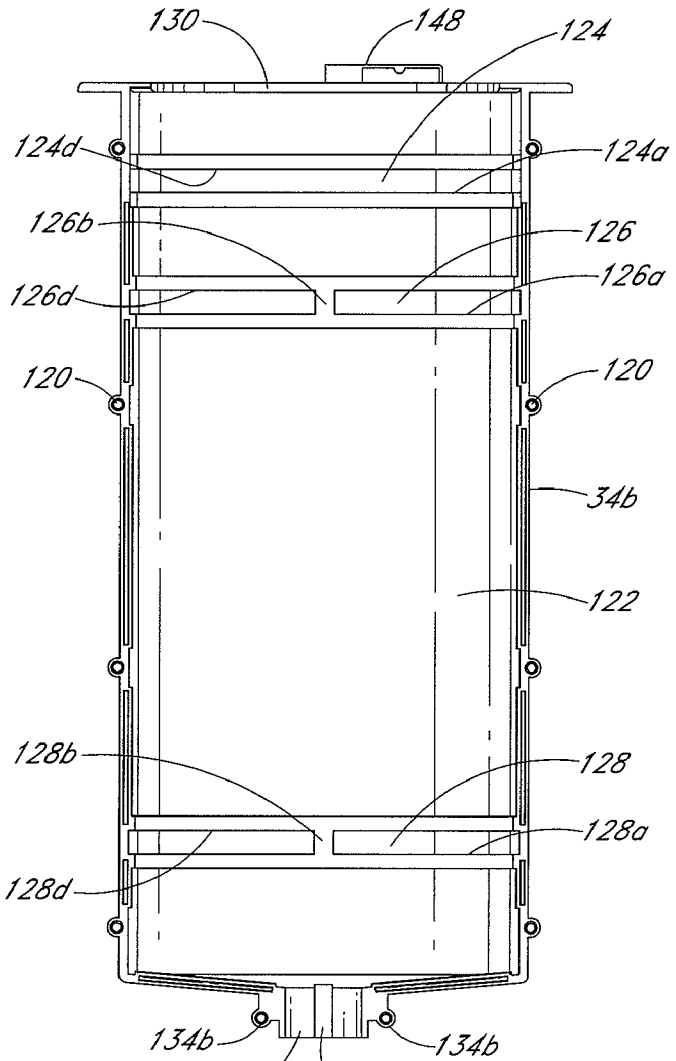
FIG. 16 is a side view of the inside of a second outer housing member from FIG. 9A.
Figure 15:
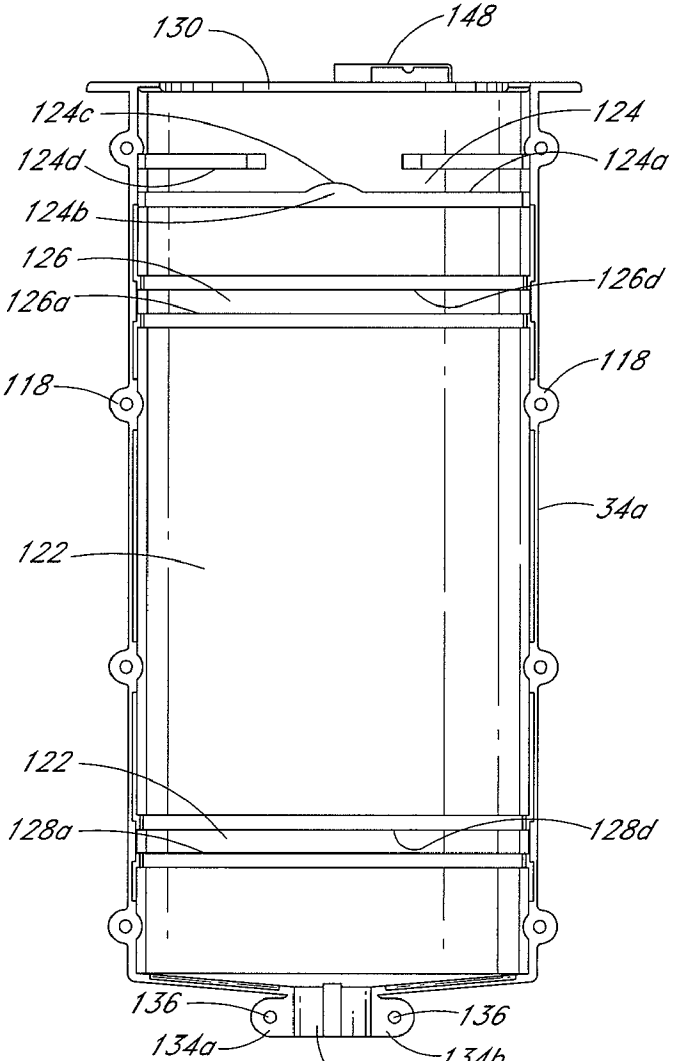
FIG. 15 is a side view of the inside of a first outer housing member from FIG. 9A.

FIG. 15 is a side view of the inside of a first outer housing member 34*a* from FIG. 9A. FIG. 16 is a side view of the inside of a second outer housing member 34*b* from FIG. 9A. As illustrated most clearly in FIG. 16, the inside surface 122 of the outer housing 34 preferably comprises an upper channel 124, a middle channel 126, and a lower channel 128. The outer housing 34 also preferably comprises an upper aperture 130, a lower aperture 132, and fastening tabs 134*a*, 134*b*. The tabs 134*a*, 134*b* may be located at a lower portion of the outer housing 34.

The upper aperture 130 is preferably configured to have a diameter that is slightly larger than the diameter of the speaker housing 38 so that the speaker member 30 is free to rotate within and translate axially through the upper aperture 130 without obstruction. Similarly, the lower aperture 132 is preferably configured to have a diameter that is slightly larger than the diameter of the mounting post 42 so that the mounting post 42 is free to translate axially through the lower aperture 132 without obstruction. Further, the fastening tabs 134*a* are preferably formed at a lower portion of the first outer housing member 34*a*, and comprise unthreaded through-holes 136. The fastening tabs 134*b* are preferably formed at a lower portion of the second outer housing member 34*a*, and comprise threaded through-holes 138. Bolts or screws are preferably passed through the unthreaded through-holes 136 and threadably inserted into the threaded through-holes 138 to attach the first outer housing member 34*a* to the second outer housing member 34*b*.

As discussed above in certain embodiments, the outer housing 34 is configured such that the user can rotate the speaker member 30 to any desired angle within or equal to an approximately 360 degree range by applying a rotational force to the outside of the speaker member 30. In the illustrated embodiments, the speaker member 30 and middle housing 32 are rotationally fixed such that they rotate together. Thus, to permit the speaker member 30 to rotate as described above, the outer housing 34 is preferably configured to permit the middle housing 32 to rotate to any desired angle within or equal to an approximately 360 degree range relative to the outer housing 34.

Figure 22:
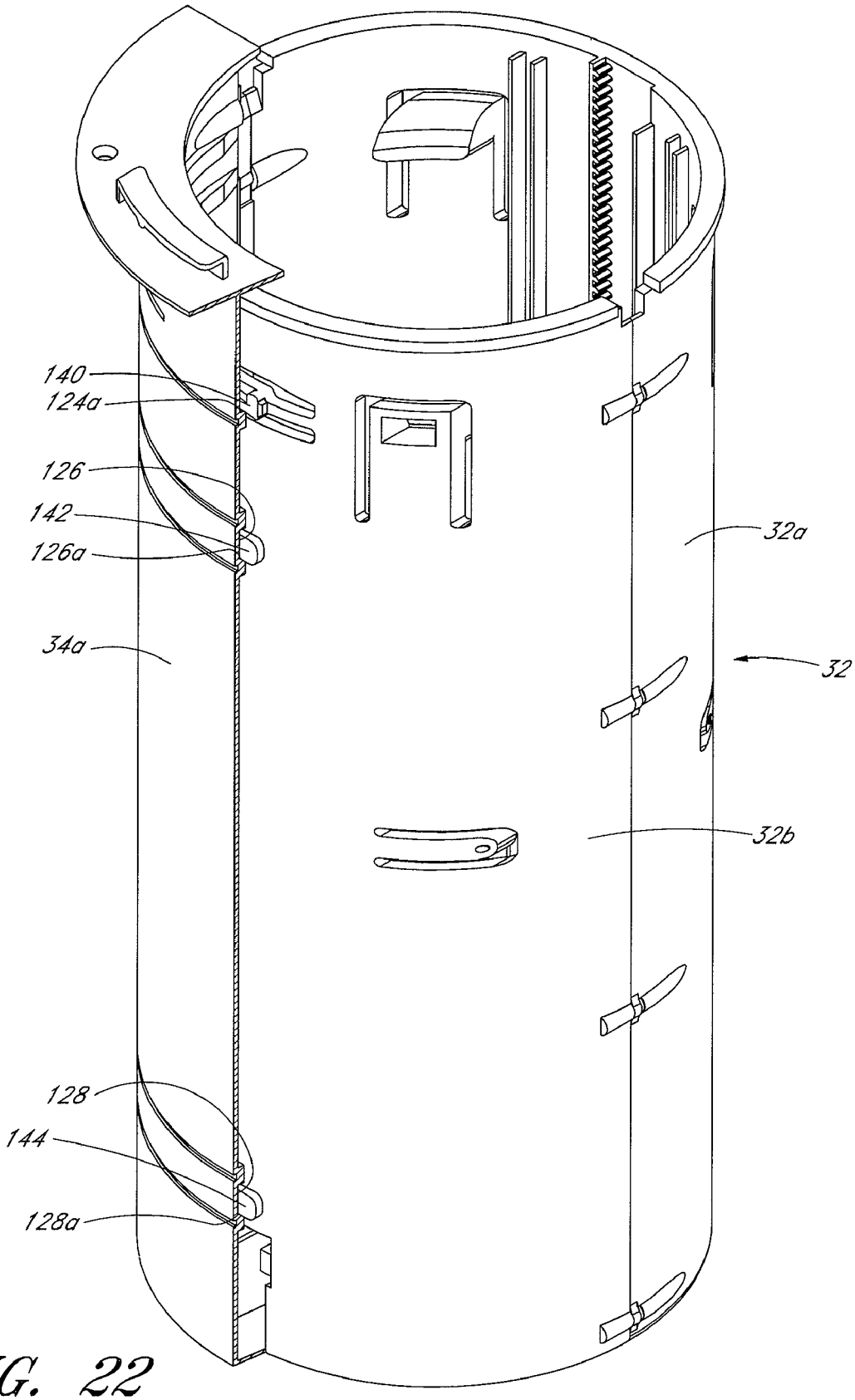
FIG. 22 is a partially sectioned perspective view through the first housing outer member and shows an upper tab and a lower tab of the middle housing member slidingly engaged with channels in the first housing member.

In the illustrated embodiments, the channels 124, 126, 128 are each preferably configured to provide a supporting surface 124*a*, 126*a*, 128*a*, respectively, to support the middle housing 32. The channels 124, 126, 128 are also each preferably configured to prevent the over-rotation of the middle housing 32 relative to the outer housing 34, which could cause damage to the audio and electrical wires 60 protruding from the speaker member 30. With reference to FIGS. 19 and 22, the first middle housing member 32*a* is preferably configured to comprise an upper tab 140, a middle tab 142, and a lower tab 144, each configured to communicate with the respective channels 124, 126, 128. As such, each of the tabs 140, 142, 144 defines a supporting surface 140*a*, 142*a*, 144*a* that is carried by the supporting surfaces 124*a*, 126*a*, 128*a*, respectively. Accordingly, the height of each tab 140, 142, 144 in the vertical direction is preferably less than the height of the interior space of each channel 124, 126, 128, respectively, in the vertical direction. This preferably enables the tabs 140, 142, 144 to freely rotate within the channels 124, 126, 128. In certain embodiments, the rotation of the tabs 140, 142, 144 relative to the channels 124, 126, 128 is limited.

For example, the outer housing 34 may be configured to permit the middle housing 32 to rotate to any desired angle within or equal to an approximately 360 degree range relative to the outer housing 34. Accordingly, in the illustrated embodiments, the channels 126, 128 preferably comprise stops 126*b*, 128*b*, respectively, that prevent the middle housing 32 from over-rotation. Additionally, the upper channel 124 preferably comprises a raised portion 124*b* defining a convex upper surface 124*c*. The surface 124*c* can releasably engage the bottom correspondingly concavely curved surface 140*a*. The raised portion 124*b* and the upper tab 140 are preferably configured such that, when the raised portion 124*b* and the upper tab 140 are aligned so that the lower surface 140*a* of the upper tab 140 is supported by the upper surface 124*c* of the raised portion 124*b*, the center of the front surface of the speaker member 30, or plane A as illustrated in FIG. 14A, will be rotationally aligned with the center of the raised portion 124*b*.

As most clearly shown in FIGS. 15 and 16, an upper inside surface 124*d*, 126*d*, 128*d* of each channel 124, 126, 128, respectively, prevents each of the tabs 140, 142, 144, respectively, and, hence, the middle housing 32, from translating a significant distance in the vertical or upward direction.

After the upper housing 34, middle housing 32, and speaker member 30 have been installed relative to the desired surface of the spa, the seal cover 36 is then preferably attached to the outer housing 34. The seal cover 36 inhibits water, moisture, or other undesired substances from entering into the spaces between the speaker member 30 and the middle housing 32, and between the middle housing 32 and the outer housing 34.

Figure 10A:
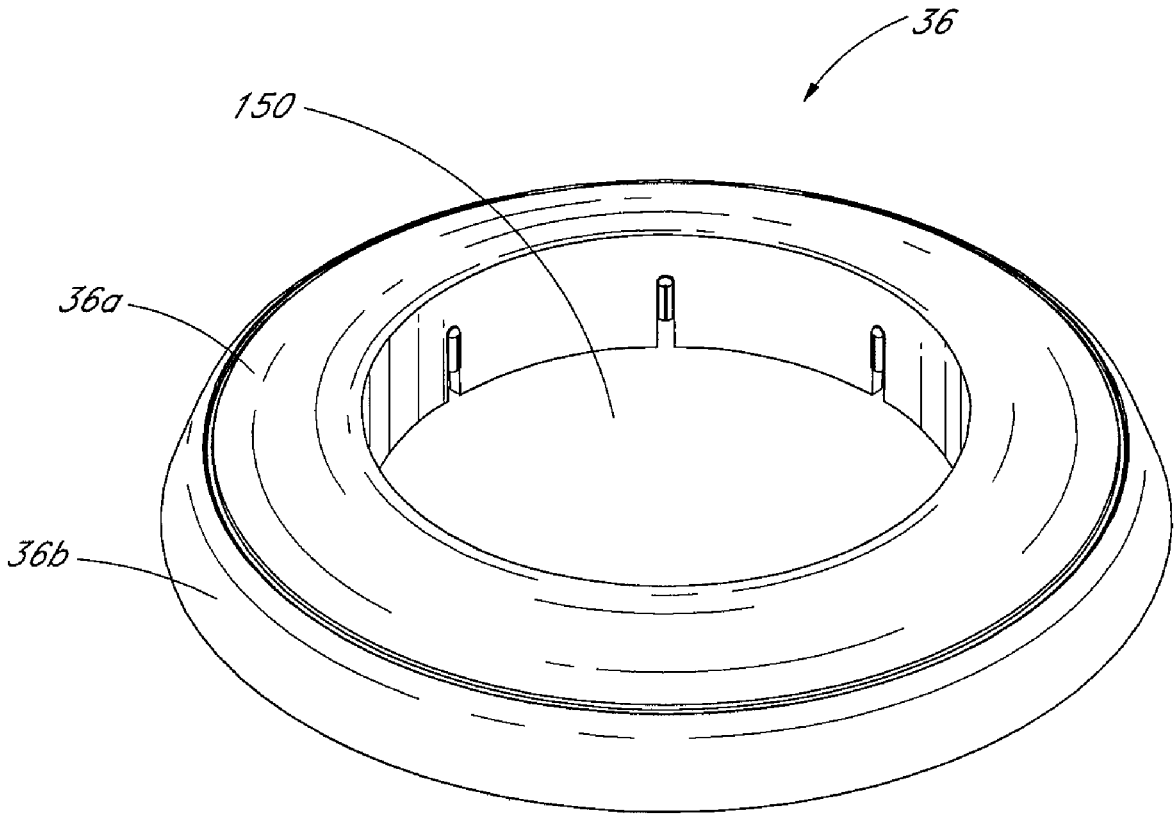
FIG. 10A is a perspective view of a cover from FIG. 9A.
Figure 10B:
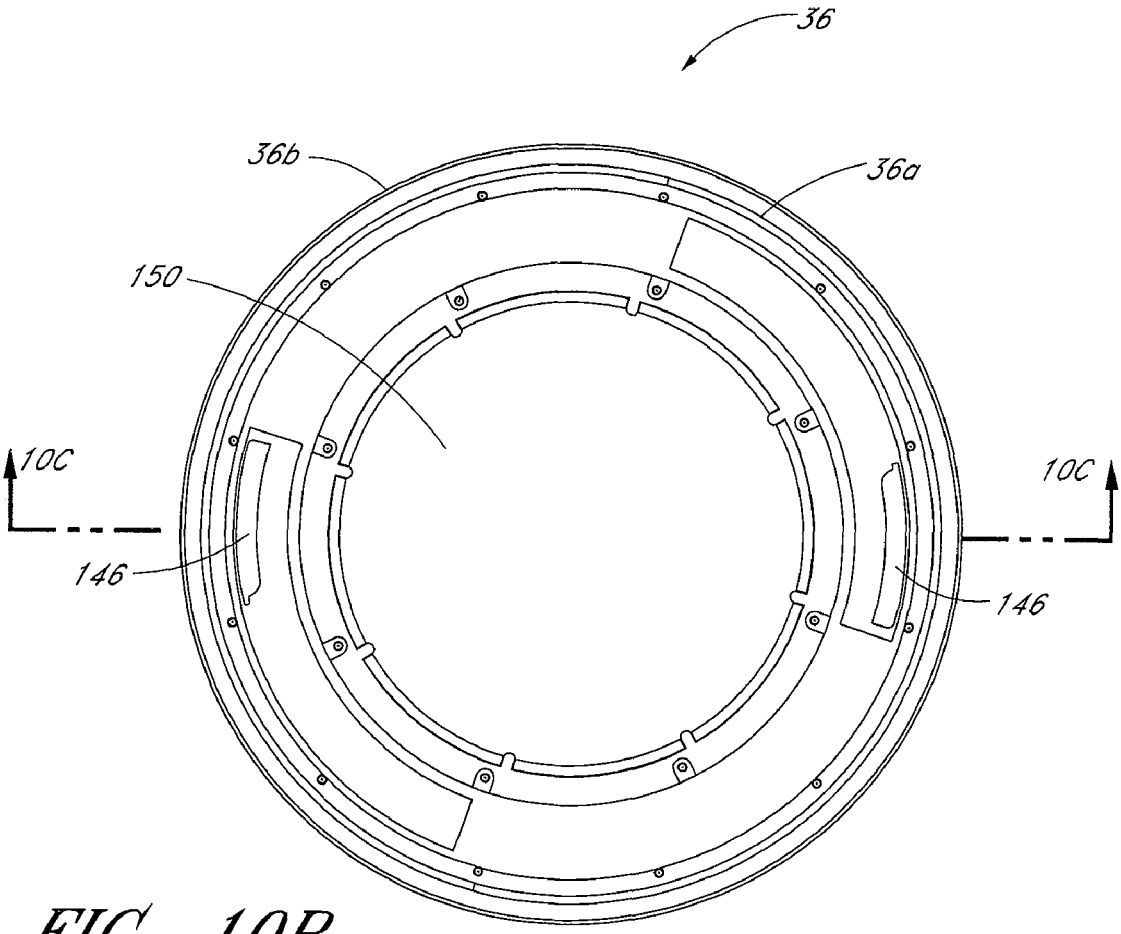
FIG. 10B is a bottom view of the cover from FIG. 10A.
Figure 10C:
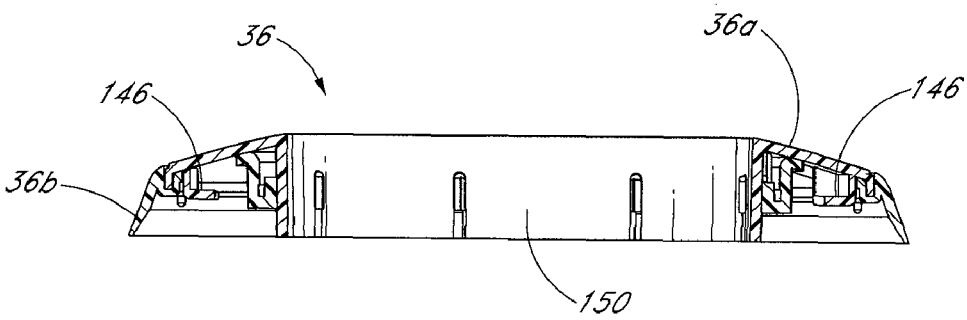
FIG. 10C is a section view of the cover taken along line 10C-10C of FIG. 10A.

FIG. 10A is a perspective view of a cover 36 from FIG. 9A. FIG. 10B is a bottom view of the cover 36 from FIG. 10A. FIG. 10C is a section view of the cover 36 taken along line 10C-10C of FIG. 10A. The seal cover 36 preferably comprises a frame portion 36*a* and a peripheral portion 36*b*. The frame portion 36*a* is preferably formed from a rigid or semi-rigid plastic material. The peripheral portion 36*b* is preferably formed from a softer, more pliable material such as, but not limited to, rubber.

Further, the frame portion 36*a* preferably comprises a pair of opposing, radially disposed flanges 146 that interacts with the corresponding flanges 148 on the top surface of the outer housing 34. When the seal cover 36 is rotated clockwise relative to the outer housing 34, the L-shaped flanges 146 formed on the seal cover 36 engage with the corresponding L-shaped flanges 148 formed on outer housing 34 to releasably secure the sealing cover 36 to the outer housing 34. The seal cover 36 may be removed from the outer housing 34 by rotating the seal cover 36 counter-clockwise relative to the outer housing 34.

The seal cover 36 preferably comprises an aperture 150. The illustrated aperture 150 has a diameter that is slightly larger than the diameter of the speaker housing 38 so that the speaker member 30 is free to rotate within and translate axially through the aperture 150 without obstruction. With reference to FIGS. 13A and 13B, an annular seal 152 can also be installed between the upper flange of the outer housing 34 and the surface of the spa to which the speaker apparatus 28 is installed to inhibit leakage through the through-hole in the mounting surface.

In some embodiments, the speaker apparatus 28 comprises a watertight seal. The seal may be formed by one or more gaskets, O-rings, or other sealant adhesives or suitable sealing means, between the speaker member 30 and the middle housing 32, or between the middle housing 32 and the outer housing 34 so as to inhibit water, moisture, or other substances from entering into the speaker apparatus 28.

One or more of the speaker apparatus 28 components such as, without limitation, the outer housing 34, the speaker housing 38, and the inner housing 52, can be formed from materials selected for their properties of resistance to chemicals, moisture, sunlight, and/or corrosion sometimes associated with pools or spas. For example, the speaker housing 38, outer housing 34, and inner housing 52, as well as other suitable components comprising the speaker apparatus 28 are preferably formed from a water impervious plastic through an injection molding process or formed of a metal such as aluminum. The speaker apparatus 28 may be formed of any suitable material, composite or otherwise, or by any suitable manufacturing process.

As mentioned, the speaker apparatus 28 is preferably configured to be mounted to any surface of a bathtub, pool, spa, or other water-containing object or water vehicle in any desired position. Additionally, a plurality of speaker assemblies 30 may be used simultaneously, as well as other audio speaker components such as a receiver, music compact disc player, DVD player, or subwoofer speaker system. Further, in some embodiments, the speaker apparatus 28 can be configured to comprise two or more preferably independently rotatable speaker members 30 located in parallel such that one is essentially positioned over the top of the other. Further, in some embodiments, the speaker apparatus 28 can be configured to comprise two or more preferably independently deployable and rotatable speaker members 30 located adjacent to one another or in parallel such that one is essentially positioned over the top of the other.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A speaker apparatus comprising:

a housing;

a speaker member configured to move between a retracted position and an extended position relative to said housing, said speaker member being positioned substantially inside said housing at least when said speaker member is in said retracted position, and said speaker member being positioned substantially outside said housing at least when said speaker member is in said extended position, said speaker member being configured to rotate relative to said housing so as to define a rotational orientation relative to said housing, said speaker member moving between said retracted position and said extended position regardless of said rotational orientation; and a damping mechanism configured to at least partially control a rate of movement of said speaker member between said retracted position and said extended position.

2. The speaker apparatus of claim 1 further comprising a biasing mechanism configured to at least in part move said speaker member between said retracted position and said extended position.

3. The speaker apparatus of claim 2, wherein the biasing mechanism comprises one or more springs.

4. The speaker apparatus of claim 3, wherein at least one of said one or more springs is a constant force roll spring.

5. The speaker apparatus of claim 1, wherein said speaker member rotates to any angle relative to said housing within an approximately 360 degree range.

6. The speaker apparatus of claim 1, wherein said speaker member is releasably biased at one or more desired rotational orientations relative to said housing.

7. The speaker apparatus of claim 1 further comprising a latch mechanism configured to releasably secure said speaker member in said retracted position.

8. The speaker apparatus of claim 7, wherein the latch mechanism is a push-push latch.

9. The speaker apparatus of claim 1 further comprising a detector for receiving wireless communication signals.

10. The speaker apparatus of claim 1, wherein said speaker apparatus is configured to permit adjustment of one or more settings of a spa, hot tub, or bath tub.

11. The speaker apparatus of claim 1, wherein said speaker apparatus is configured to permit the user to adjust one or more settings of an entertainment system.

12. The speaker apparatus of claim 11, wherein said entertainment system comprises an audio system.

13. The speaker apparatus of claim 11 further comprising wires, said wires connecting said speaker apparatus to said entertainment system.

14. The speaker apparatus of claim 1 further comprising wires, said wires connecting said speaker apparatus to a control system of a spa, hot tub, or bath tub.

15. A speaker apparatus comprising:

an outer housing;

a middle housing rotatable relative to said outer housing so as to define a rotational orientation relative to said outer housing;

a speaker member engaged with said middle housing so that said speaker member and said middle housing rotate together relative to said outer housing, said speaker member moving between a retracted position and an extended position relative to said middle housing, said speaker member being positioned substantially inside said middle housing at least when said speaker member is in said retracted position, and said speaker member being positioned substantially outside said middle housing at least when said speaker member is in said extended position; and a biasing mechanism moving at least in part said speaker member from said retracted position to said extended position independent of said rotational orientation of said speaker member.

16. The speaker apparatus of claim 15 further comprising a damping mechanism configured to at least partially control a rate of axial movement of said speaker member relative to said middle housing.

17. A spa comprising:

at least one speaker comprising, a housing and a speaker member, said speaker member being configured to simultaneously rotate and axially translate relative to said housing so as to move between a retracted position and an extended position, said speaker member being positioned substantially inside said housing at least when said speaker member is in said retracted position, and said speaker member being positioned substantially outside of said housing at least when said speaker member is in said extended position; and a damping mechanism configured to at least partially control a rate of movement of said speaker member between said retracted position and said extended position.

18. The spa of claim 17 further comprising a biasing mechanism moving at least in part said speaker member from said retracted position to said extended position.

19. The spa of claim 17, wherein said speaker member is configured to rotate at least from 0 to 270 degrees relative to said housing.

20. The spa of claim 17 further comprises a latch mechanism configured to releasably secure said speaker member in said retracted position.

21. The spa of claim 17 further comprising a detector for receiving wireless communication signals.

22. The spa of claim 17, wherein said speaker member comprises a first driver and a second driver.

23. The spa of claim 22, wherein said first driver is disposed off-axis relative to said second driver.

24. The spa of claim 17, wherein a top surface of said speaker member is disposed so as to be substantially flush with an exterior mounting surface of said spa when said speaker member is in said retracted position.

25. A speaker apparatus comprising:

a housing; and a speaker member configured to move between a retracted position and an extended position relative to said housing, said speaker member being positioned substantially inside said housing at least when said speaker member is in said retracted position, and said speaker member being positioned substantially outside said housing at least when said speaker member is in said extended position, said speaker member being configured to rotate relative to said housing so as to define a rotational orientation relative to said housing, said speaker member moving between said retracted position and said extended position regardless of said rotational orientation, wherein said speaker apparatus is configured to permit adjustment of one or more settings of a spa, hot tub, or bath tub.

26. A speaker apparatus comprising:

a housing;

a speaker member configured to move between a retracted position and an extended position relative to said housing, said speaker member being positioned substantially inside said housing at least when said speaker member is in said retracted position, and said speaker member being positioned substantially outside said housing at least when said speaker member is in said extended position, said speaker member being configured to rotate relative to said housing so as to define a rotational orientation relative to said housing, said speaker member moving between said retracted position and said extended position regardless of said rotational orientation; and wires connecting said speaker apparatus to a control system of a spa, hot tub, or bath tub.

* * * * *